US008538611B2

(12) United States Patent
Kumar et al.

(10) Patent No.: US 8,538,611 B2
(45) Date of Patent: Sep. 17, 2013

(54) MULTI-LEVEL RAILWAY OPERATIONS OPTIMIZATION SYSTEM AND METHOD

(75) Inventors: Ajith K. Kumar, Erie, PA (US); Paul K. Houpt, Schenectady, NY (US); Stephen S. Mathe, Melbourne, FL (US); Paul M. Julich, Indialantic, FL (US); Jeffrey Kisak, Erie, PA (US); Glenn Shaffer, Erie, PA (US); Scott D. Nelson, Albion, PA (US)

(73) Assignee: General Electric Company, Schenectady, NY (US)

( * ) Notice: Subject to any disclaimer, the term of this patent is extended or adjusted under 35 U.S.C. 154(b) by 155 days.

(21) Appl. No.: 10/736,089

(22) Filed: Dec. 15, 2003

(65) Prior Publication Data

US 2004/0133315 A1 Jul. 8, 2004

Related U.S. Application Data

(60) Provisional application No. 60/438,234, filed on Jan. 6, 2003.

(51) Int. Cl.
*G06F 19/00* (2011.01)

(52) U.S. Cl.
USPC ..... 701/20; 700/291

(58) Field of Classification Search
USPC ..... 701/213, 117, 50, 207, 20, 24, 29, 701/30, 33, 35, 19, 123, 10; 246/5, 167 R, 246/187 C, 182 R, 187 R, 182 B; 340/933; 706/45, 16, 23; 477/2; 700/291, 297
See application file for complete search history.

(56) References Cited

U.S. PATENT DOCUMENTS 5,129,605 A * 7/1992 Burns et al. ..... 246/5
5,177,684 A * 1/1993 Harker et al. ..... 701/117
5,420,883 A * 5/1995 Swensen et al. ..... 375/138

(Continued)

FOREIGN PATENT DOCUMENTS

EP 0 554 983 A1 1/1993
EP 000554983 A1 * 8/1993
EP 0 958 987 A2 5/1999
EP 1 293 948 A2 9/2002

OTHER PUBLICATIONS

PCT International Search Report for PCT Patent Application PCT/US2004/020910, Nov. 25, 2004, 8 pages, European Patent Office, Massalski, M.

*Primary Examiner* — Ronnie Mancho
(74) *Attorney, Agent, or Firm* — GE Global Patent Operation; John A. Kramer

(57) ABSTRACT

A multi-level system for management of a railway system and its operational components in which the railway system has a first level configured to optimize an operation within the first level that includes first level operational parameters which define operational characteristics and data of the first level, and a second level configured to optimize an operation within the second level that includes second level operational parameters which define the operational characteristic and data of the second level. The first level provides the second level with the first level operational parameters, and the second level provides the first level with the second level operational parameters, such that optimizing the operation within the first level and optimizing the operation within the second level are each a function of optimizing a system optimization parameter. The levels can include a railroad infrastructure level, a track network level, a train level, a consist level and a locomotive level.

8 Claims, 18 Drawing Sheets

(56) References Cited

U.S. PATENT DOCUMENTS

| | | | | |
|---|---|---|---|---|
| 5,623,413 | A | 4/1997 | Matheson et al. | |
| 5,794,172 | A * | 8/1998 | Matheson et al. | 701/117 |
| 5,828,979 | A * | 10/1998 | Polivka et al. | 701/117 |
| 5,836,529 | A * | 11/1998 | Gibbs | 246/122 R |
| 6,135,396 | A | 10/2000 | Whitfield et al. | |
| 6,144,901 | A * | 11/2000 | Nickles et al. | 701/19 |
| 6,154,735 | A * | 11/2000 | Crone | 706/45 |
| 6,263,266 | B1 * | 7/2001 | Hawthorne | 701/19 |
| 6,490,523 | B2 * | 12/2002 | Doner | 701/213 |
| 6,622,068 | B2 * | 9/2003 | Hawthorne | 701/19 |
| 6,631,322 | B1 * | 10/2003 | Arthur et al. | 701/211 |
| 7,073,753 | B2 * | 7/2006 | Root et al. | 246/72 |
| 2001/0029411 | A1 * | 10/2001 | Hawthorne | 701/19 |
| 2002/0065698 | A1 * | 5/2002 | Schick et al. | 705/8 |
| 2003/0055666 | A1 * | 3/2003 | Roddy et al. | 705/1 |
| 2003/0213875 | A1 | 11/2003 | Hess, Jr. et al. | |
| 2003/0236598 | A1 * | 12/2003 | Villarreal Antelo et al. | 701/19 |
| 2006/0005736 | A1 * | 1/2006 | Kumar | 105/1.4 |

* cited by examiner

RAILROAD TRACK NETWORK LEVEL OPTIMIZATION - DETAILS

INTERFACE TRAIN LEVEL TO MOVEMENT PLANNER

NETWORK FUEL MANAGER MODULE

LOCOMOTIVE LEVEL OPTIMIZATION - LOSSES VS DC LINK VOLTAGE

LOCOMOTIVE LEVEL OPTIMIZATION - FUEL USAGE VS ENGINE SPEED

MULTI-LEVEL RAILWAY OPERATIONS OPTIMIZATION SYSTEM AND METHOD

CROSS REFERENCE TO RELATED APPLICATIONS

This application claims priority to U.S. Provisional Patent Application No. 60/438,234 filed Jan. 6, 2003.

FIELD OF THE INVENTION

This invention relates to optimizing railway operations, and more particularly to a system and method of optimizing railway operations using a multi-level, system-wide approach.

BACKGROUND OF THE INVENTION

Railways are complex systems, with each component being interdependent on other components within the system. Attempts have been made in the past to optimize the operation of a particular component or groups of components of the railway system, such as for the locomotive, for a particular operating characteristic such as fuel consumption, which is a major component of the cost of operating a railway system. Some estimates indicate that fuel consumption is the second largest railway system operating cost, second only to labor costs.

For example, U.S. Pat. No. 6,144,901 proposes optimizing the operation of a train for a number of operating parameters, including fuel consumption. However, optimizing the performance of a particular train, which is only one component of a much larger system; including, for example, the railway network of track, other trains, crews, rail yards, departure points, and destination points, may not yield an overall system-wide optimization. Optimizing the performance of only one component of the system (even though it may be an important component such as a train) may actually result in increased system-wide costs, because this prior art approach does not consider the interrelationships and impacts on other components and on the overall railway system efficiency. As one example, optimizing at the train ignores potential efficiencies for a locomotive within the individual train, which efficiencies may be available if the locomotives were free to optimize their own performance.

One system and method of planning at the railway track network system is disclosed in U.S. Pat. No. 5,794,172. Movement planners such as this are primarily focused on movement of the trains through the network based on business objective functions (BOF) defined by the railroad company, and not necessarily on the basis of optimizing performance or a particular performance parameter such as fuel consumption. Further, the movement planner does not extend the optimization down to the train (much less the consist or locomotive), nor to the railroad service and maintenance operations that plan for the servicing of the trains or locomotives.

Thus, in the prior art, there has been no recognition that optimization of operations for a railway system requires a multi-level approach, with the gathering of key data at each level and communicating data with other levels in the system.

SUMMARY OF THE INVENTION

One aspect of the present invention is the provision of a multi-level system for management of a railway system and its operational components in which the railway system comprises a first level configured to optimize an operation within the first level that includes first level operational parameters which define operational characteristics and data of the first level, and a second level configured to optimize an operation within the second level that includes second level operational parameters which define the operational characteristic and data of the second level. The first level provides the second level with the first level operational parameters, and the second level provides the first level with the second level operational parameters, such that optimizing the operation within the first level and optimizing the operation within the second level are each a function of optimizing a system optimization parameter.

A further aspect of the present invention includes the provision of a method for optimizing an operation of a railway system having first and second levels which comprises communicating from the first level to the second level a first level operational parameter that defines an operational characteristic of the first level, communicating from the second level to the first level a second level operational parameter that defines an operational characteristic of the second level, optimizing a system operation across a combination of the first level and the second level based on a system optimization parameter, optimizing an operation within the first level based on a first level optimization parameter and based in part on the system optimization parameter, and optimizing an operation within the second level based on a second level optimization parameter and based in part on the system optimization parameter.

Another aspect of the present invention is the provision of a method and system for multi-level railway operations optimization for a complex railroad system that identifies key operating constraints and data at each level, communicates these constraints and data to adjacent levels and optimizes performance at each level based on the data and constraints of adjacent levels.

Aspects of the present invention further include establishing and communicating updated plans and monitoring and communicating compliance with the plans at multiple levels of the system.

Aspects of the invention further include optimizing performance at the railroad infrastructure level, railway track network level, individual train level within the network, consist level within the train, and the individual locomotive level within the consist.

Aspects of the invention further include optimizing performance at the railroad infrastructure level to enable condition-based, rather than scheduled-based, servicing of locomotives, including both temporary (or short-term) servicing requirements such as fueling and replenishment of other consumable materials on-board the locomotive, and long-term servicing requirements such as replacement and repair of critical locomotive operating components, such as traction motors and engines.

Aspects of the invention include optimizing performance of the various levels in light of the railroad operating company's business objective functions, such as on-time deliveries, asset utilization, minimum fuel usage, reduced emissions, optimized crew costs, dwell time, maintenance time and costs, and reduced overall system costs.

These Aspects of the invention provide benefits such as reduced journey-to-journey fuel usage variability, fuel savings for each locomotive operating within the system, graceful recovery of the system from upsets, elimination of out-of-fuel mission failures, improved fuel inventory handling logistics and decreased autonomy of crews in driving decisions.

DETAILED DESCRIPTION OF THE PREFERRED EMBODIMENT

Figure 1:
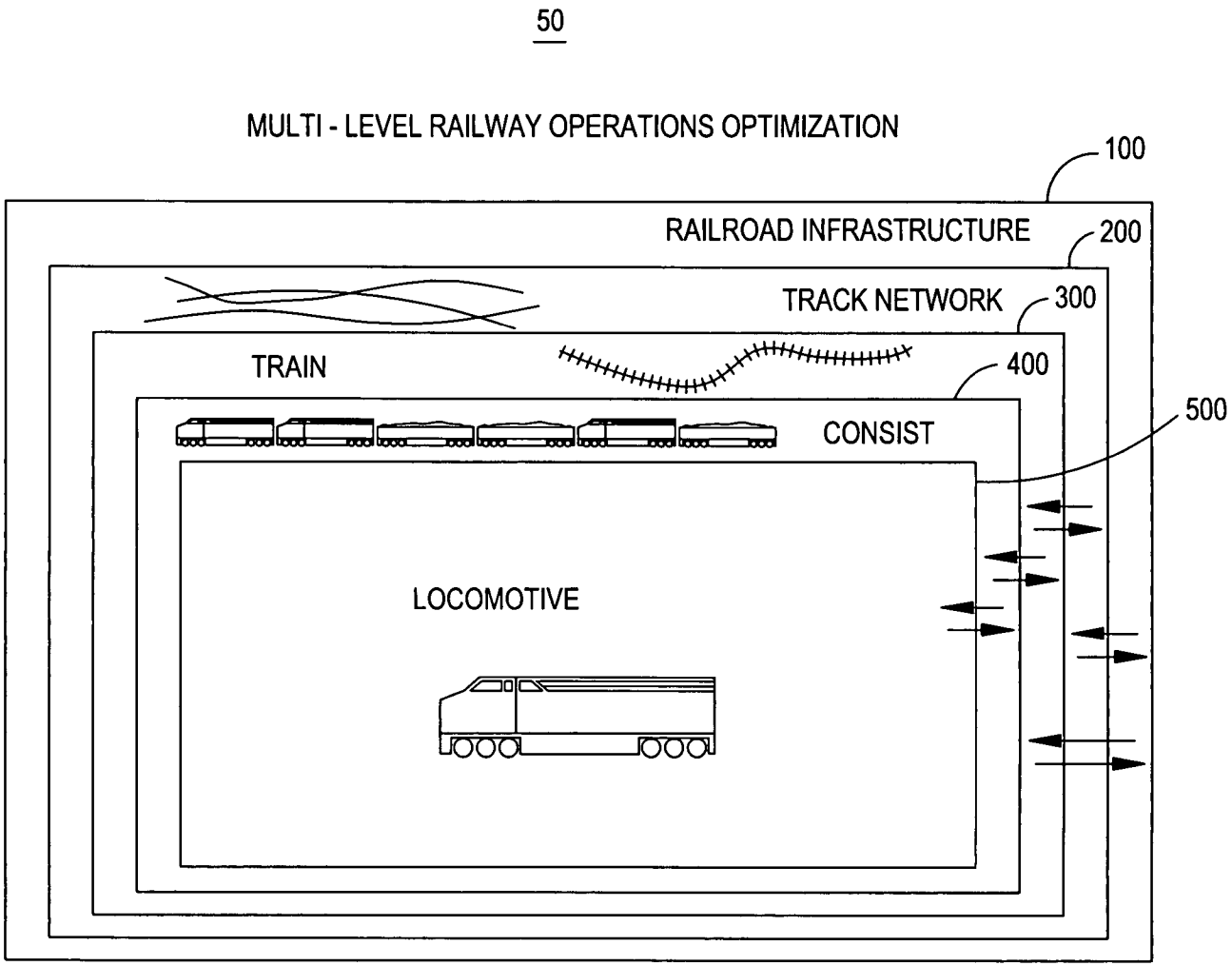
FIG. 1 is a graphical depiction of the multi-level nature of railway operations optimization of this invention, with the railroad infrastructure, railroad track network, train, locomotive consist and individual locomotive levels being depicted in their respective relationships to each other.

Referring to FIG. 1, the multi-level nature of a railway system 50 is depicted. As shown, the system comprises from the highest level to the lowest level: a railroad infrastructure level 100, a track network level 200, a train level 300, a consist level 400 and a locomotive level 500. As described hereinafter, each level has its own unique operating characteristics, constraints, key operating parameters and optimization logic. Moreover, each level interacts in a unique manner with related levels, with different data being interchanged at each interface between the levels so that the levels can cooperate to optimize the overall railway system 50. The method for optimization of the railway system 50 is the same whether considered from the locomotive level 500 up, or the railroad infrastructure system 100 down. To facilitate understanding, the latter approach, a top down perspective, will be presented.

Railway Infrastructure Level

Optimization of the railway system 50 at the railroad infrastructure level 100 is depicted in FIGS. 1-4. As indicated in FIG. 1, the levels of the multi-level railway operations system 50 and method include from the top down, the railroad infrastructure level 100, the track network level 200, the train level 300, the consist level 400 and the locomotive level 500. The railroad infrastructure level 100 includes the lower levels of track network 200, train 300, consist 400 and locomotive level 500. In addition, the infrastructure level 100 contains other internal features and functions that are not shown, such as servicing facilities, service sidings, fueling depots, wayside equipment, rail yards, train crews operations, destinations, loading equipment (often referred to as pickups), unloading equipment (often referred to as set-outs), and access to data that impacts the infrastructure, such as: railroad operating rules, weather conditions, rail conditions, business objective functions (including costs, such as penalties for delays and damages enroute, and awards for timely delivery), natural disasters, and governmental regulatory requirements. These are features and functions that are contained at the railroad infrastructure level 100. Much of the railroad infrastructure level 100 is of a permanent basis (or at least of a longer term basis). Infrastructure components such as the location of wayside equipment, fueling depots and service facilities are not subject to change during the course of any given train trip. However, real-time availability of these components may vary depending on availability, time of day, and use by other systems. These features of the railroad infrastructure level 100 act as opportunities or resources and constraints on the operation of the railway system 50 at the other levels. However, other aspects of the railroad infrastructure level 100 are operable to serve other levels of the railway system 50 such as track networks, trains, consists or locomotives, each of which may be optimized as a function of a multilevel optimization criteria such as total fuel, refueling, emissions output, resource management, etc.

Figure 2:
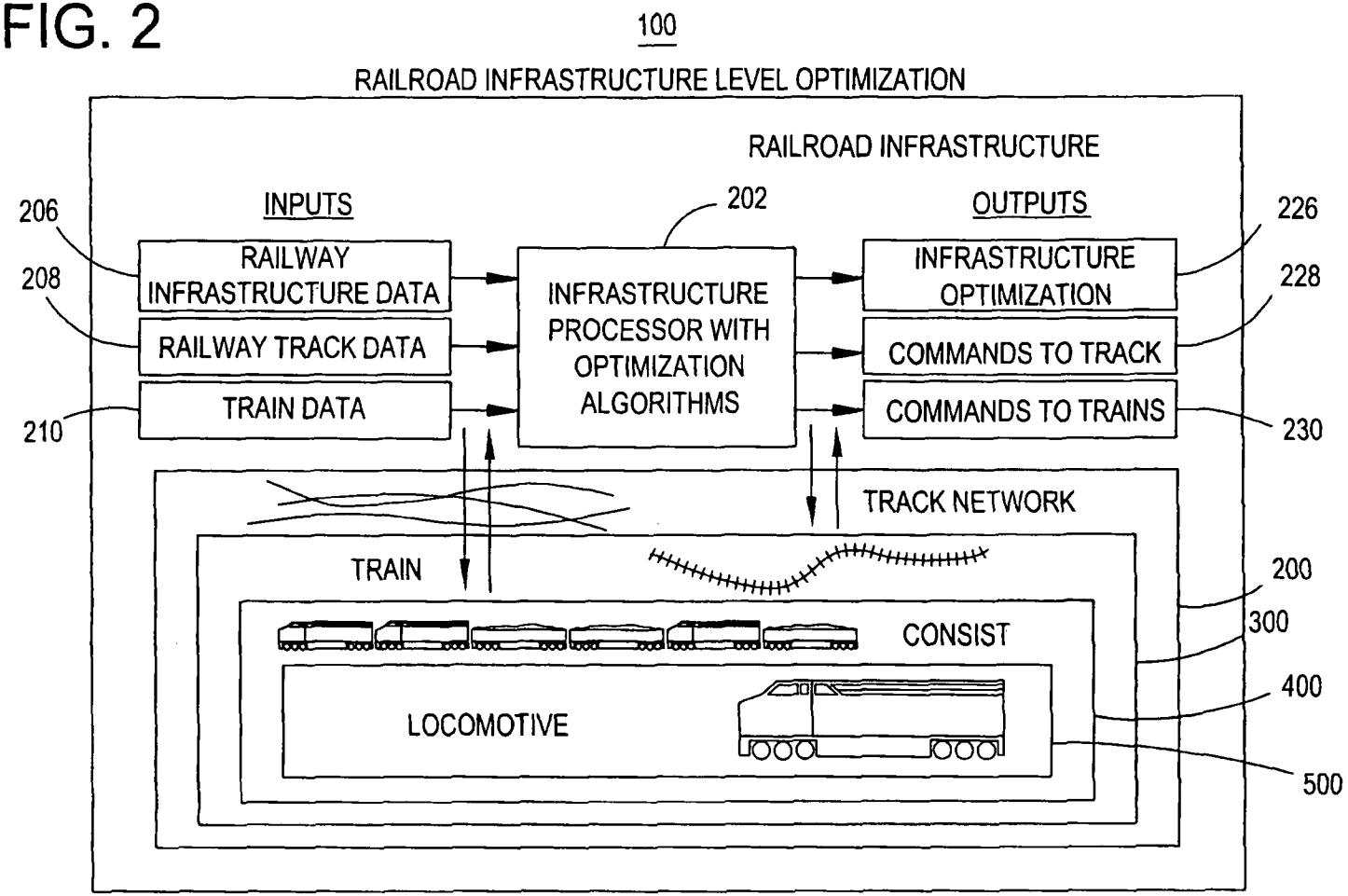
FIG. 2 is a graphical depiction of the railroad infrastructure level illustrating the inputs and outputs to the infrastructure processor at this level.

FIG. 2 provides a schematic of the optimization of the railroad infrastructure level 100. It illustrates the infrastructure level 100 and the infrastructure level processor 202 interacting with track level 200 and train level 300 to receive input data from these levels, as well as from within the railroad infrastructure level 100 itself, to generate commands to and/or provide data to the track network level 200 and the train level 300, and to optimize operation within the railroad infrastructure level 100.

Figure 3:
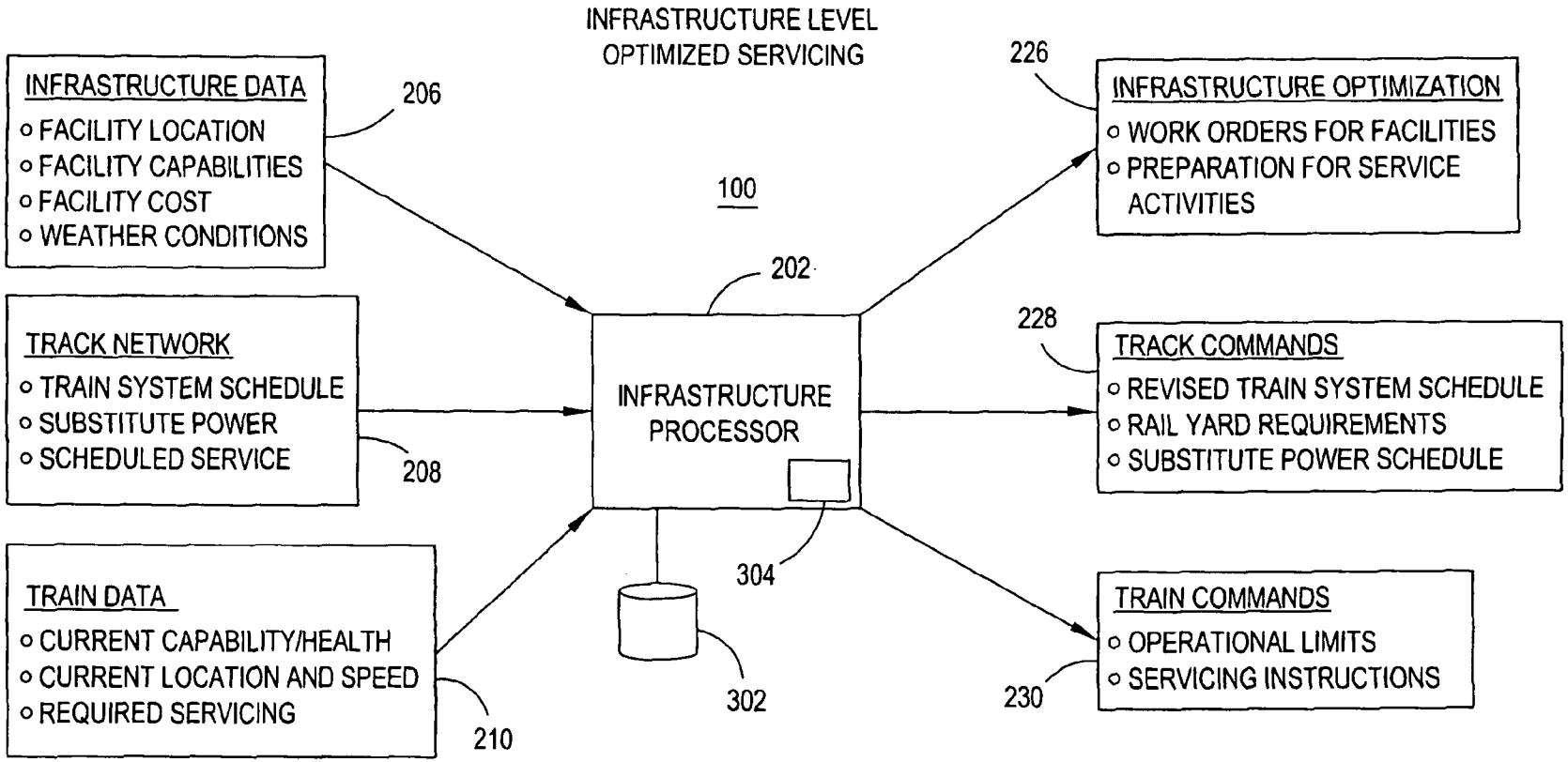
FIG. 3 is a schematic illustrating details of optimized servicing operations at the infrastructure level.

As illustrated in FIG. 3, infrastructure processor 202 may be a computer, including memory 302, computer instructions 304 including an optimization algorithms, etc. The infrastructure level 100 includes, for example, the servicing of trains and locomotives such as at maintenance facilities and service sidings to optimize these servicing operations, the infrastructure level 100 receives infrastructure data 206 such as facility location, facility capabilities (both static characteristics such as the number of service bays, as well as dynamic characteristics, such as the availability of bays, service crews, and spare parts inventory), facility costs (such as hourly rates, downtime requirements), and the earlier noted data such as weather conditions, natural disaster and business objective functions. The infrastructure level also receives track network level data 208, such as the current train system schedule for the planned arrival and departure of railroad equipment at the service facility, the availability of substitute power (i.e., replacement locomotives) at the facility and scheduled service. In addition, the infrastructure level receives train level data 210, such as the current capability of trains on the systems, particularly those with health issues that may require additional condition-based (as opposed to scheduled-based) servicing, the current location, speed and heading of trains, and the anticipated servicing requirements when the train arrives. The infrastructure processor 202 analyzes this input data and optimizes the railroad infrastructure level 100 operation by issuing work orders or other instructions to the service facilities for the particular trains to be serviced, as indicated in block 226, which includes instructions for preparing for the work to be done such as scheduling work bays, work crews, tools, and ordering spare parts. The infrastructure level 100 also provides instructions that are used by the lower level systems. For example, track commands 228 are issued to provide data to revise the train movement plan in view of a service plan, advise the rail yard of the service plan such as reconfiguring the train, and provide substitute power of a replacement locomotive. Train commands 230 are issued to the train level 300 so that particular trains that are to be serviced may have restricted operation or to provide on-site servicing instructions that are a function of the service plan.

Figure 4:
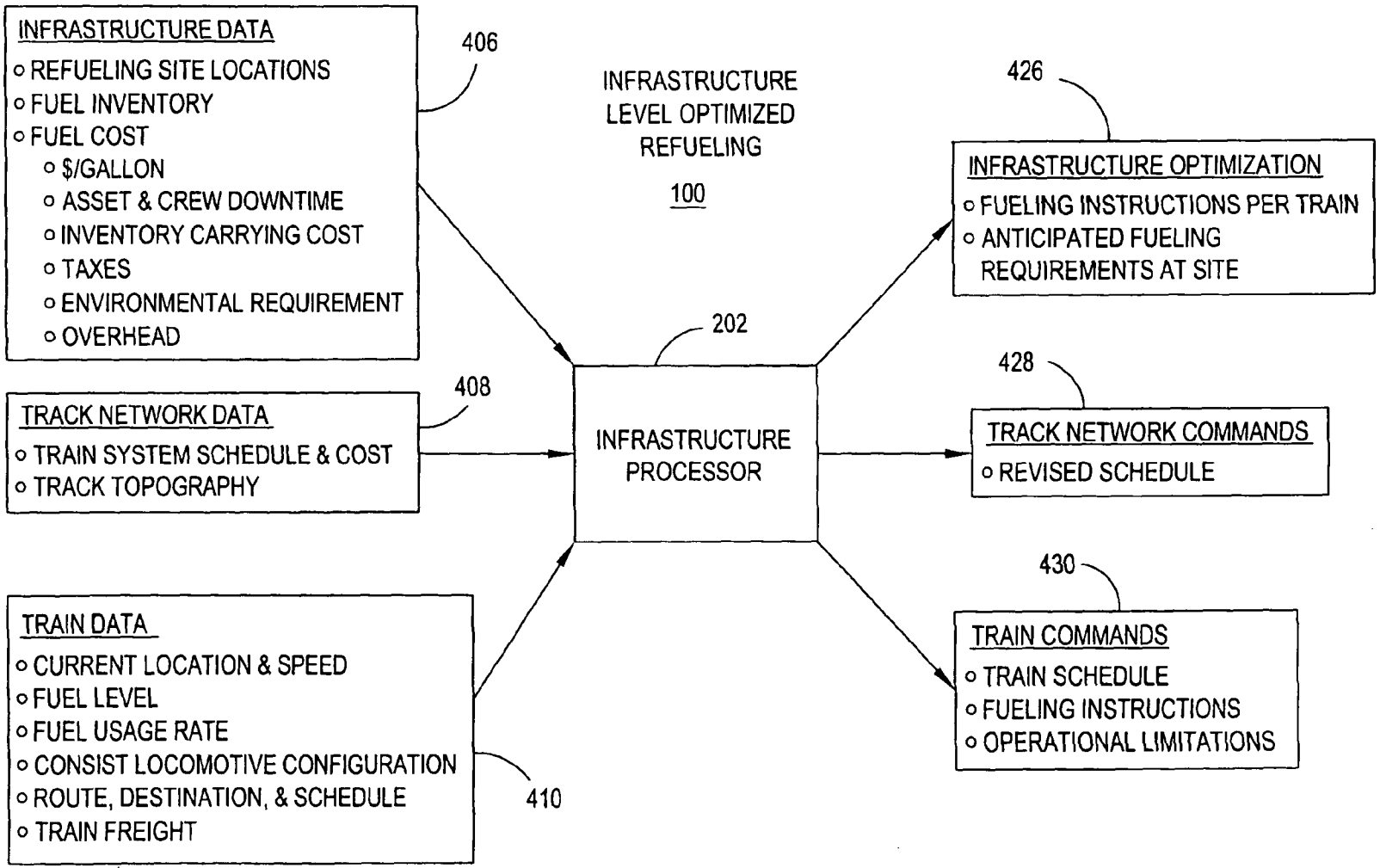
FIG. 4 is a schematic illustrating details of optimized refueling operations at the infrastructure level.

As one example of the operations of the infrastructure level 100, FIG. 4 shows an infrastructure level optimized refueling 400. This is a particular instance of optimized servicing at the infrastructure level 100. The infrastructure data 406 input to the infrastructure level 400 for optimizing refueling are related to fueling parameters. These include refueling site locations (which include the large service facilities as well as fuel depots, and even sidings at which fuel trucks can be dispatched) and total fuel costs, which includes not only the direct price per gallon of the fuel, but also asset and crew downtime, inventory carrying costs, taxes, overhead and environmental requirements. Track network level input data 408 includes the cost of changing the train schedule on the overall movement plan to accommodate refueling or reduced speeds if fueling is not done, as well as the topography of the track ahead of the trains since it has a major impact on fuel usage. Train level input data 410 includes current location and speed, fuel level and fuel usage rate data (which can be used to determine locomotive range of travel) as well as consist configuration so that alternative locomotive power generation modes can be considered. Train schedule as well as train weight, freight and length are relevant to the anticipated fuel usage rate. Outputs from the optimum refueling infrastructure level 400 include optimization of the fueling site both in terms of the fueling instructions for each particular train but also as anticipated over some period of time for fuel inventory purposes. Other outputs include command data 428 to the track network level 200 to revise the movement plan, and train level commands 430 for fueling instructions at the facility site, including schedules, as well as operational limitations on the train such as the maximum rate of fuel usage while the train is enroute to the fuel location.

Optimization of the railroad infrastructure operation is not a static process, but rather is a dynamic process that is subject to revision at regular scheduled intervals (such as every 30 minutes) or as significant events occur and are reported to the infrastructure level 100 (such as train brake downs and service facility problems). Communication within the infrastructure level 100 and with the other levels may be done on a real-time or near real-time basis to enable the flow of key information necessary to keep the service plans current and distributed to the other levels. Additionally, information may be stored for later analysis of trends or the identification or analysis of particular level characteristics, performance, interactions with other levels or the identification of particular equipment problems.

Railroad Track Network Level

Figure 5:
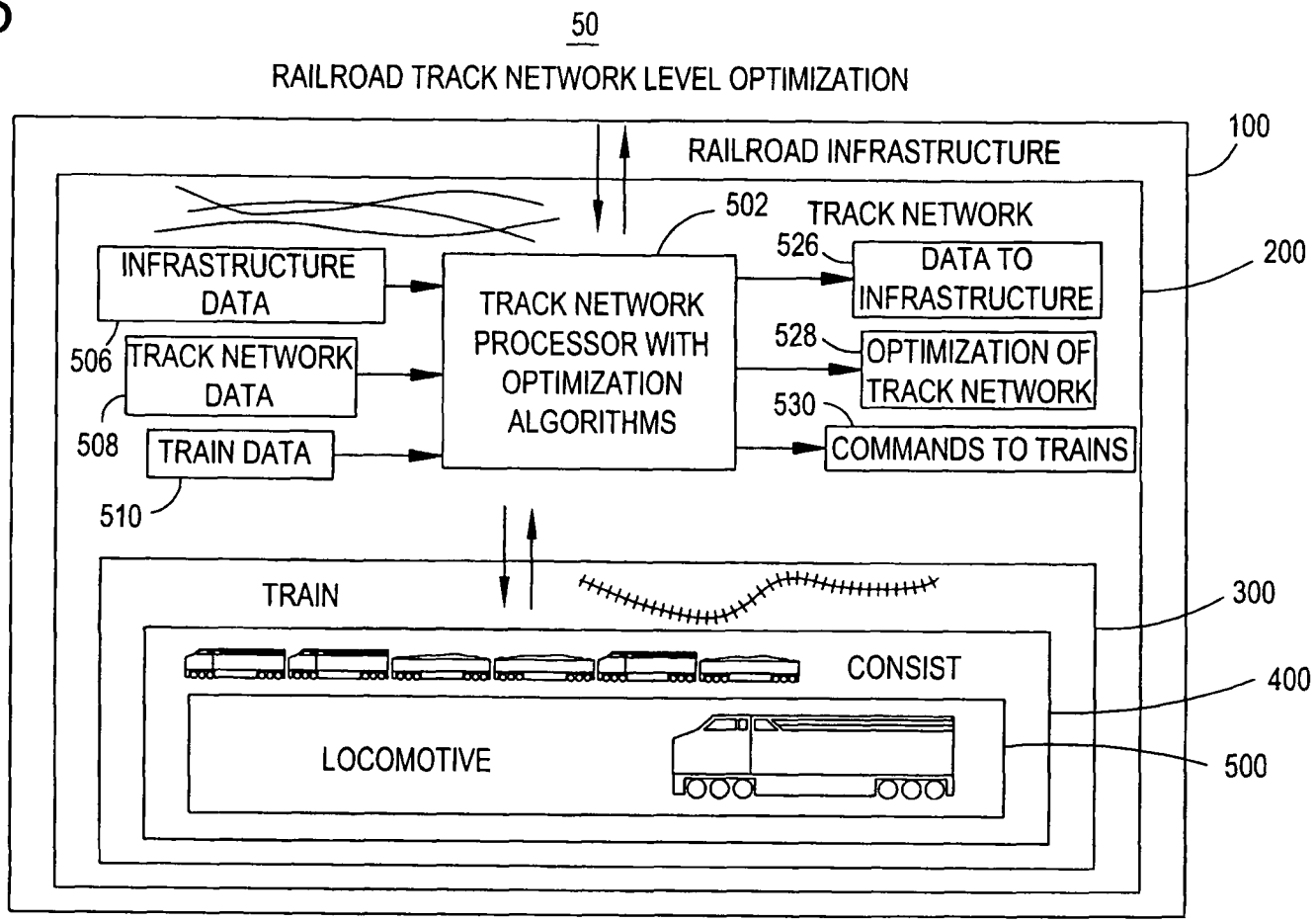
FIG. 5 is a schematic of the railroad track network level illustrating its relationships with the railroad infrastructure above it and the train level below it.
Figure 6:
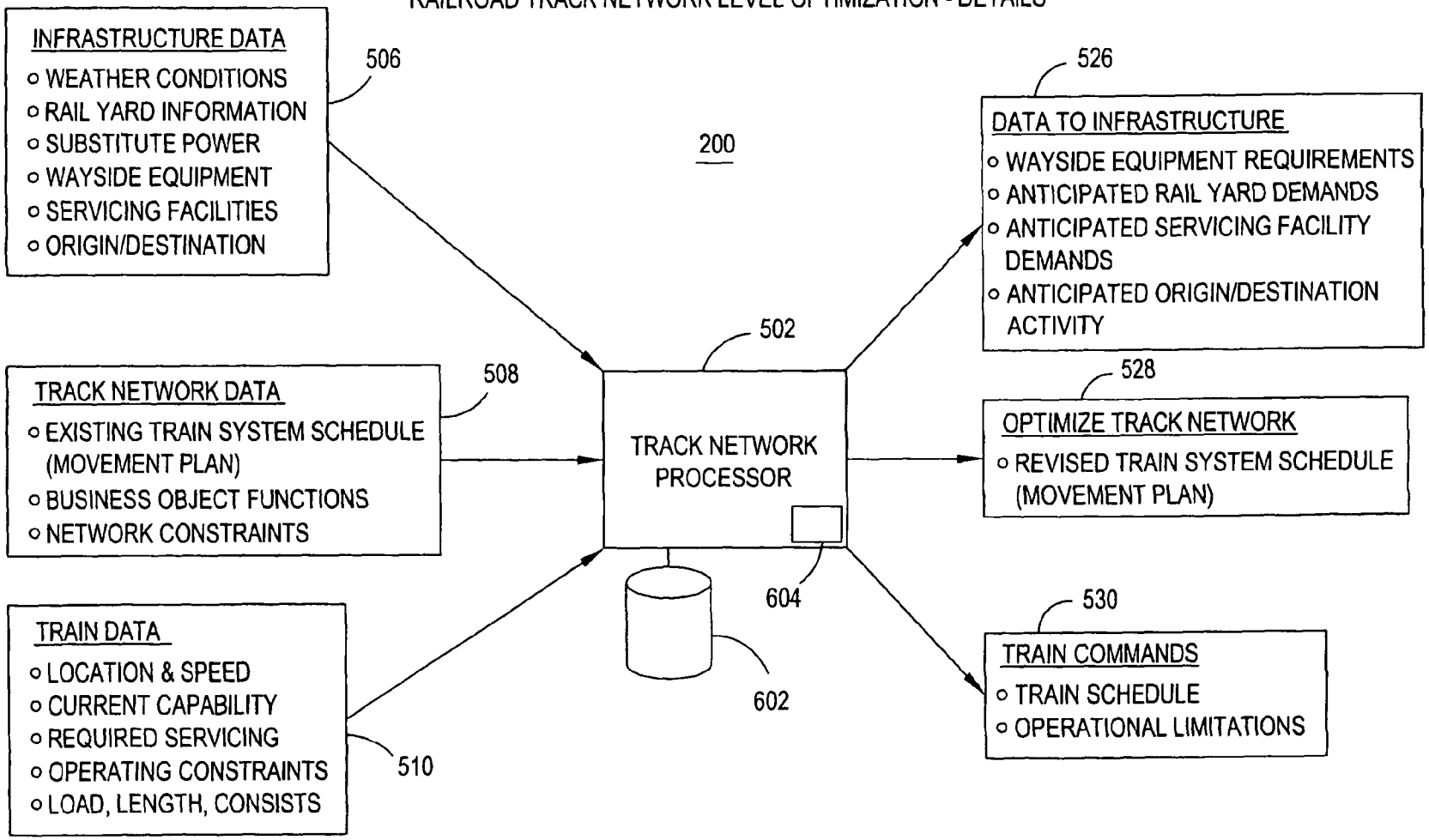
FIG. 6 is a schematic illustrating details of the railroad track network level, with inputs to and outputs from the processor at this level.

Within the operational plans of the railroad infrastructure, optimization of the railroad track network level 200 is performed as depicted in FIGS. 5 and 6. The railroad track network level 200 includes not only the track layout, but also plans for movement of the various trains over the track layout. FIG. 5 shows the interaction of the track network level 200 with the railroad infrastructure level 100 above it and the individual trains below it. As illustrated, the track network level 200 receives input data from the infrastructure level 100 and the train level 300, as well as data (or feedback) from within the railroad network level 200. As illustrated in FIG. 6, track network processor 502 may be a computer, including memory 602, computer instructions 604 including an optimization algorithms, etc. As shown in FIG. 6, the infrastructure level data 506 includes information regarding the condition of the weather, rail yard, substitute power, servicing facilities and plans, origins and destinations. Track network data 508 includes information regarding the existing train movement schedule, business object functions and network constraints (such as limitations on the operation of certain sections of the track). Train level input data 510 includes information regarding locomotive location and speed, current capability (health), required servicing, operating limitations, consist configurations, trainload and length.

FIG. 6 also shows the output of the track network level 200 that includes data 526 sent to the infrastructure level, commands 530 to the trains and optimization instructions 528 to the track network level 200 itself. The data 526 sent to the infrastructure level 100 includes wayside equipment requirements, rail yard demands, servicing facility needs, and anticipated origin and destination activities. The train commands 530 include the schedule for each train and operational limitations enroute, and the track network optimization 528 includes revising the train system schedule.

As with the infrastructure level 100, the railroad track network 200 schedule (or movement plan) is revised at periodic intervals or as material events occur. Communication of the input and output of critical data and command may be done on a real-time basis to keep the respective plans current.

An example of an existing movement planner is disclosed in U.S. Pat. No. 5,794,172. Such a system includes a prior art computer aided dispatch (CAD) system having a power dispatching system movement planner for establishing a detailed movement plan for each locomotive and communicating to the locomotive. More particularly, such a movement planner plans the movement of trains over a track network with a defined planning horizon such as 8 hours. The movement planner attempts to optimize a railroad track network level Business Objective Function (BOF) that is the sum of the BOF's for individual trains in the train levels of the railroad track network level. The BOF for each train is related to the termination point for the train. It may also be tied to any point in the individual train's trip. In the prior art, each train had a single BOF for each planning cycle in a planning territory. Additionally, each track network system may have a discrete number of planning territories. For example, a track network system may have 7 planning territories. As such, a train that will traverse N territories will have N BOF's at any instance in time. The BOF provides a means of comparing the quality of two movement plans.

In the course of computing each train's movement plan each hour, the movement planner compares thousands of alternative plans. The track network level problem is highly constrained by the physical layout of track, track or train operating restrictions, the capabilities of trains, and conflicting requirements for the resources. The time required to compute a movement plan in order to support the dynamic nature of railroad operations is a major constraint. For this reason, train performance data is assumed, based on pre-computed and stored data based upon train consist, track conditions, and train schedule. The procedure used by the movement planner computes the minimum run time for a train's schedule by simulating the train's unopposed movement over the track, with stops and dwells for work activities. This process captures the run time across each track segment and alternate track segment in the train's path. A planning cushion, such as a percentage of run time, is then added to the train's predicted run time and the cushioned time is used to generate the movement plan.

Figure 20:
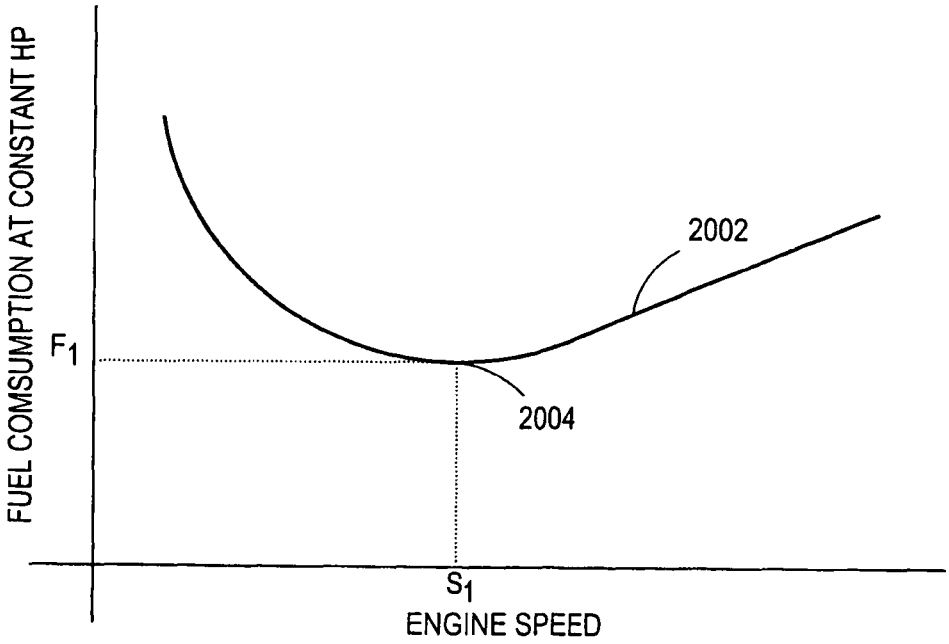
FIG. 20 is a graphic illustrating fuel consumption as a function of engine speed at the locomotive level.

One such prior art movement planner is illustrated in FIG. 20, where the train (and thus the train level, consist level, locomotive level/engine) is at an optimum speed $S_1$ along the speed/fuel consumption curve 2002 resulting in reduced fuel consumption at the bottom 2004 of curve 2002. Typical train speeds exceed the optimum train speed $F_1$, so that reducing average train speeds usually results in reduced fuel consumption.

Figure 7:
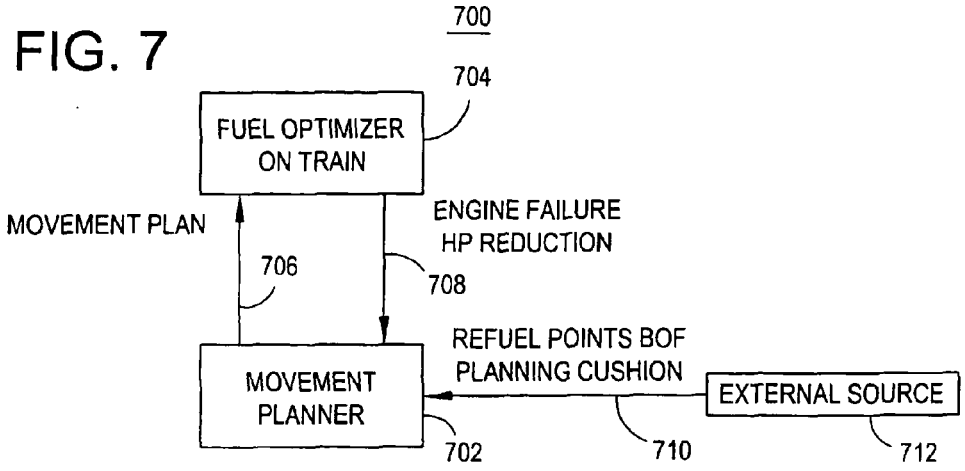
FIG. 7 is a schematic illustrating inputs to and outputs from an existing movement planner at the train level.
Figure 8:
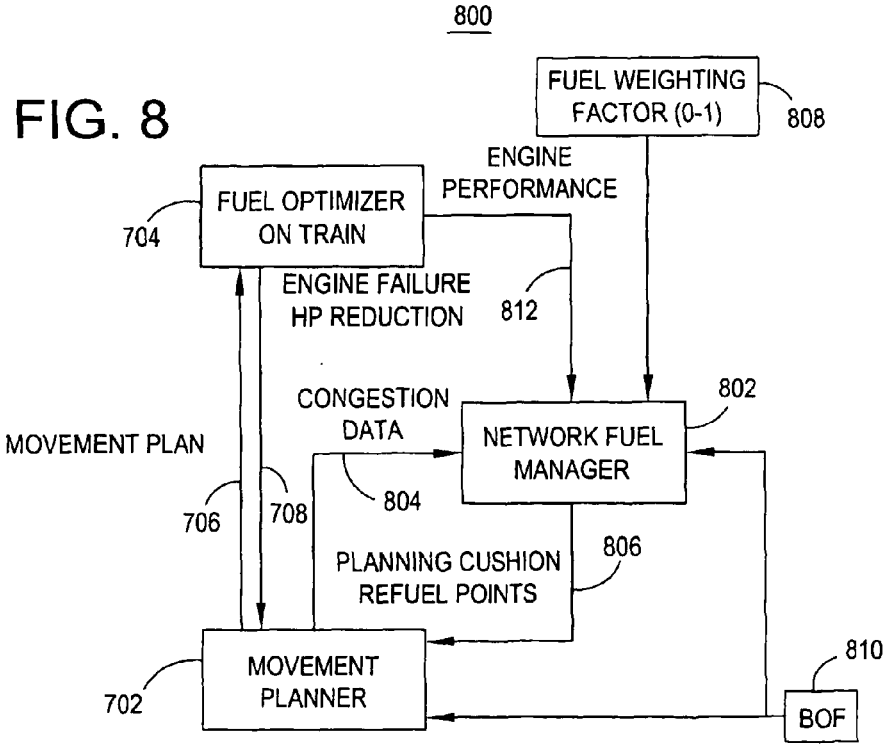
FIG. 8 is a schematic of a revised railroad network processor having a network fuel manager processor for optimization of additional fuel usage parameters.

FIGS. 7 and 8 illustrate details of an embodiment of the invention and its benefits to movement planning of the track network level 200. FIG. 7 illustrates an example of a movement planner 700 to analyze operating parameters to optimize the train movement plan for optimizing fuel usage. The movement planner 702 receives input from the train level 300. The FIG. 7 embodiment of the movement planner 702 receives and analyzes messages to the movement planner 702 from external sources 712 with respect to refueling points and the Business Objective Functions (BOF) 710 including a planning cushion as mentioned above. A communication link 706 to the fuel optimizers 704 on trains in the train levels 300 is provided in order to transmit the latest movement plan to each of the trains on the train level 300. In the prior art, the movement planner attempted to minimize delays for meets and passes. In contrast, the system according to one embodiment of the present invention utilizes these delays as an opportunity for fuel optimization at the various levels.

FIG. 8 illustrates a movement planner for analyzing additional operating parameters beyond those illustrated in FIG. 7 for optimizing fuel optimization. The network fuel manager 802 provides the track network level 200 with functionality to optimize fuel usage within the track network level 200 based on the Business Objective Function (BOF) 810 of each of the trains at the train level 300, the engine performance 812 of the trains and locomotives comprising those trains, congestion data 804 and fuel weighting factors 808. The movement planner at the track network level receives input 708 from the train level optimizer 704 and from the network fuel manager 802. For example, the train level 200 provides the movement planner 702 with engine failure and horsepower reduction data 708. The movement planner 702 provides a movement plan 706 to the train level 200 and congestion data 804 to the network fuel manager 802. The train level 200 provides engine performance data 812 to the network fuel manager 802. The movement planner 702 at the track network level 200 utilizes the Business Objective Function (BOF) for each train, the planning cushion and refueling points 806 and the engine failure and horsepower reduction data 708, to develop and modify the movement plan for a particular train at the train level 200.

As mentioned above, the FIG. 8 embodiment of the movement planner 702 incorporates a network fuel manager module 802 or fuel optimizer that monitors the performance data for individual trains and provides inputs to the movement planner to incorporate fuel optimization information into the movement plan. This module 802 determines refueling locations based upon estimated fuel usage and fuel costs as well. A fuel cost weighting factor represents the parametric balancing of fuel costs (both direct and indirect) against schedule compliance. This balance is considered in conjunction with the congestion anticipated in the path of the train. Slowing a train for train level fuel optimization can increase congestion at the track network level by delaying other trains especially in highly trafficked areas. The network fuel manager module 802 interfaces to the movement planner 702 within the track network level 200 to set the planning cushion (amount of slack time in the plan before appreciably affecting other train movements) for each train and modifies the movement plan 706 to allow individual train planning cushions to be set, with longer planning cushions and shorter meets and passes than typical to provide for improved fuel optimization.

A further enhancement specifies a higher planning cushion for trains that are equipped with a fuel optimizer 704 and whose schedules are not critical. This provides savings to local trains and trains running on lightly trafficked rail. This involves an interface to the movement planner 702 to set the planning cushion for the train and a modification to the movement plan 706 to allow the planning cushion to be set for individual trains.

Figure 9:
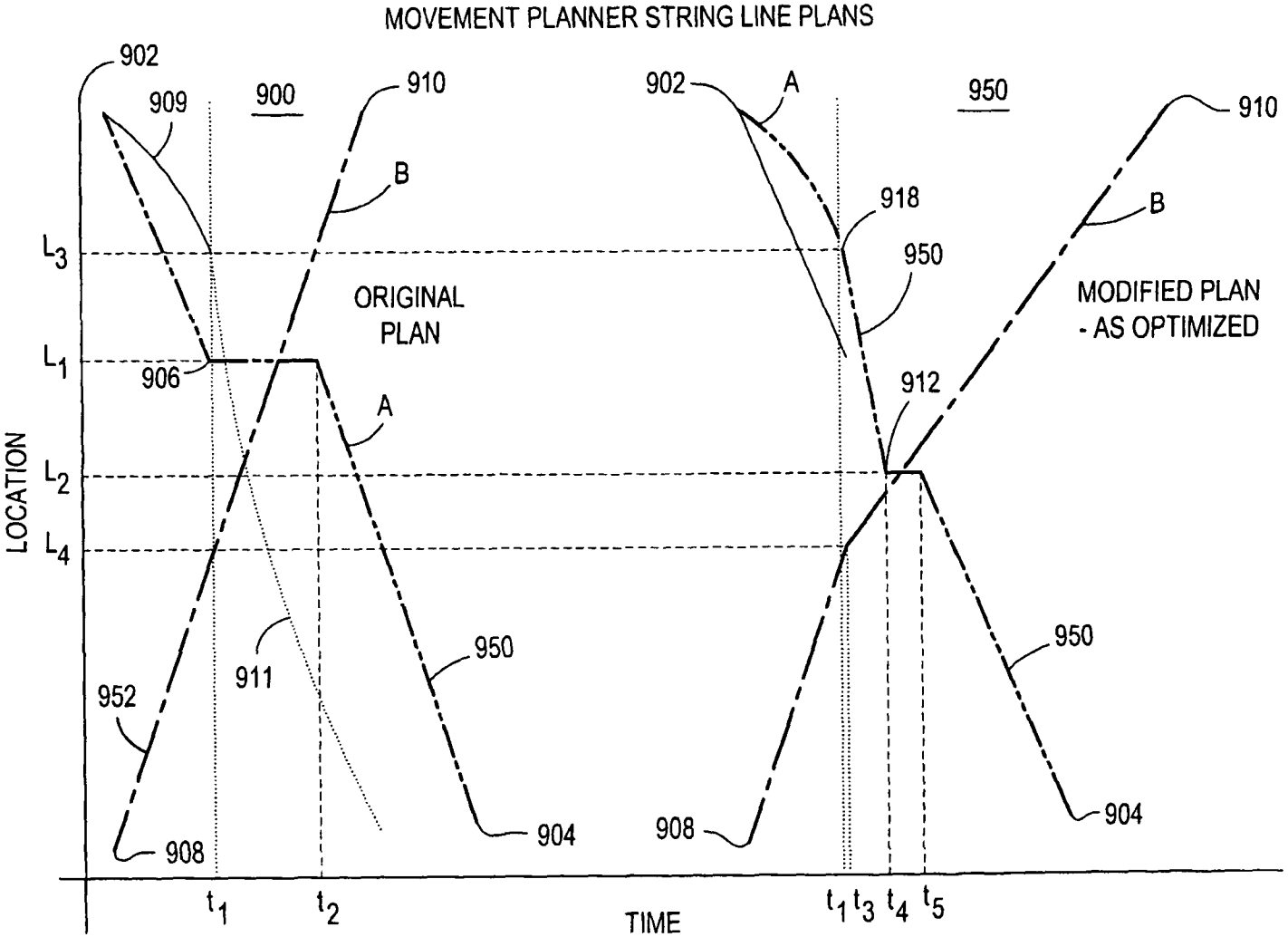
FIG. 9 is a pair of string-line diagrams, with the first diagram being an initial movement plan done without consideration of operational optimization and the second diagram being a modified plan as optimized for reduced fuel consumption.

FIG. 9 illustrates a representative set of string line graphs for the planned movement (movement plan 706) of two trains (i.e., trains A and B) moving in opposite directions on a single track, thereby requiring that the trains meet and pass at a siding 906. The string line shows the train location as a function of travel time for the trains, with line A illustrating the travel of train A as it moves from its initial location 902 near the top of the chart to its final location 904 near the bottom of the chart, and the travel of train B from its initial location 908 at the bottom of the chart to its final location 910 at the top of the chart. The "original plan" 900 as shown in the first string line of FIG. 9 is generated solely for the purpose of minimizing the time required to effect the train movements. This string line shows that train A enters a siding 906 represented by the horizontal line segment 906 at time $t_1$, so as to let train B pass. Train A is stopped and idle at siding 906 from $t_1$ to $t_2$. Train B, as shown by line 908-910, maintains a constant speed from 908 to 910. The upper curved line 909 and curved dotted line extension 911 represents the fastest move that train A is capable of performing. The "modified plan" 950 as shown in the string line on the right of FIG. 9 was generated with consideration for fuel optimization. It requires that train A travel faster (steeper slope of line 918-912 from $t_1$ to $t_4$) so as to reach a second and more distant siding 912, albeit at a somewhat later time $t_4$, e.g., $t_4$ is later than $t_1$. The modified plan also requires that train B slow its rate of travel at time $t_3$ so as to pass at the second siding 912. The modified plan reduces the idle time of train A to $t_5-t_4$ from the previous $t_2-t_1$ and reduces the speed of train B beginning at $t_3$ to create the opportunity for fuel optimization at the train level 300 as reflected by the combination of the two particular trains, while maintaining the track network level movement plan at or near its earlier level of performance.

Inputs to the track network level movement planner 702 also includes locations of fuel depots, cost of fuel ($/gallon per depot and cost of time to fuel or so-called "cost penalty"), engine efficiency as represented by the slope of the change in the fuel use over the change in the horsepower (e.g., slope of Δfuel use/ΔHP), fuel efficiency as represented by the slope of the change in the fuel use over the change in speed or time, derating of power for locomotives with low or no fuel, track adhesion factors (snow, rain, sanders, cleaners, lubricants), fuel level for locomotives in trains, and projected range for fuel of the train.

The railroad track network level functionality established by the movement planner 702 includes determination of required consist power as a function of speed under current or projected operating conditions, and determination of fuel consumption as a function of power, locomotive type, and network track. The movement planner 702 determinations may be for locomotives, for the consist or the train which would include the assigned load. The determination may be a function of the sensitivity of the change of fuel over the change of power (ΔFuel/ΔHP) and/or change in horsepower over speed (ΔHP/ΔSpeed). The movement planner 702 further determines the dynamic compensation to fuel-rate (as provided above) to account for thermal transients (tunnels, etc.), and adhesion limitations, such as low speed tractive effort or grade, that may impair movement predictions, e.g., the expected speed. The movement planner 702 may predict the current out-of-fuel range based on an operating assumption such as that the power continues at the current level or an assumption regarding the future track. Finally, the detection of parameters that have changed significantly may be communicated to the movement planner 702, and as a result, an action such as a change in the movement plan may be required. These actions may be automatic functions that are communicated continuously, periodically, or done on exception basis such as for detection of transients or predicted out-of-fuel conditions.

The benefits of this operation of the track network level 200 includes allowing the movement planner 702 to consider fuel use in optimizing the movement plan without regard to details at the consist level, to predict fuel-rate as a function of power and speed, and by integration, to determine the expected total fuel required for the movement plan. Additionally, the movement planner 702 may predict the rate of schedule deterioration and make corrective adjustments to the movement plan if needed. This may include delaying the dispatch of trains from a yard or rerouting trains in order to relieve congestion on the main line. The track network level 200 also will enable the factoring of the dynamic consist fuel state into refueling determination at the earliest opportunity, including the consideration of power loss, such as when one locomotive within a consist shuts down or is forced to operate at reduced power. The track network level 200 will also enable the determination (at the locomotive level or consist level) of optimum updates to the movement plan. This added optimization data reduces the monitoring and signal processing required in the movement plan or computer aided dispatch processes.

The movement plan output from the track network level 200 specifies where and when to stop for fuel, amount of fuel to take on, lower and upper speed limits for train, time/speed at destination, and time allotted for fueling.

Train Level

Figure 10:
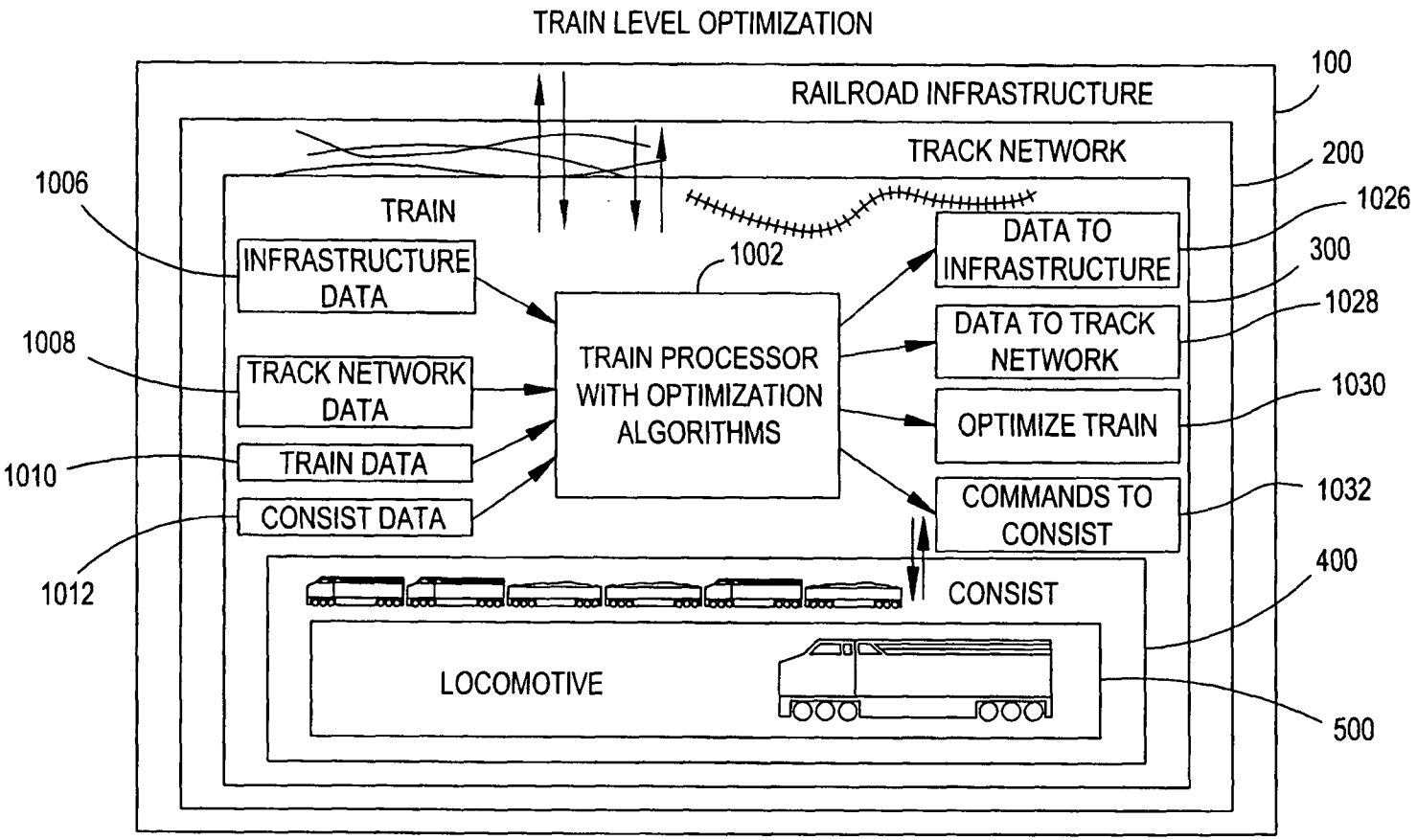
FIG. 10 is a schematic of the train level illustrating its relationship with its related levels.
Figure 11:
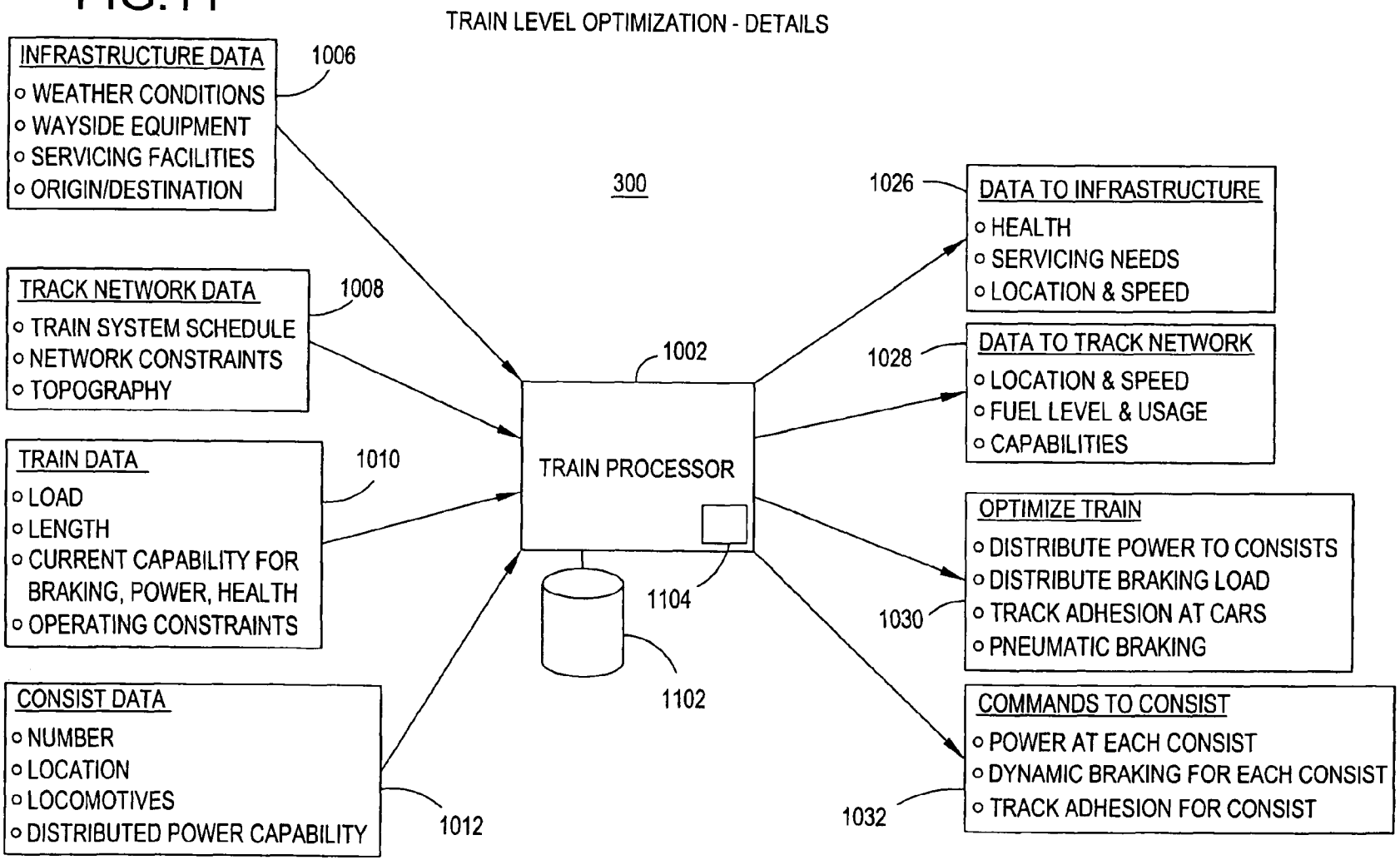
FIG. 11 is a schematic illustrating details of the inputs and outputs of the train level processor.

FIGS. 10 and 11 depict the train level operation and relationships between the train level 300 and the other levels. The train processor 1002 may include a memory 1102 and computer instructions 1104 including an optimization algorithm, etc. While the train level 300 may comprise a long train with distributed consists, each consist with several locomotives and with numerous cars between the consists, the train level 300 may be of any configuration including more complex or significantly simpler configurations. For example, the train may be formed by a single locomotive consist or a single consist with multiple locomotives at the head of the train both of which configurations simplify the levels, interactions and amount of data communicated from the train level 300 to the consist level 400 and on to the locomotive level 500. In the simplest case, a single locomotive without any cars may constitute a train. In this case, the train level 300, consist level 400 and locomotive level 500 are the same. In such as case, the train level processor, the consist level processor and the locomotive level processor may be comprised of one, two or three processors.

Assuming for discussion purposes a more complex train configuration, then the input data at the train level 300, as shown in FIGS. 10 and 11, includes infrastructure data 1006, railway track network data 1008, train data 1010, including feedback from the train, and consist level data 1012. The output of the train level includes data sent to the infrastructure level 1026 and to the track network level 1028, optimization within the train level 1030 and commands to the consist level 1032. The railroad infrastructure level input data 1006 includes weather conditions, wayside equipment, servicing facilities and origin/destination information. The track network level data input 1008 includes train system schedule, network constraints and track topography. The train data input 1010 includes load, length, current capacity for braking and power, train health, and train operating constraints. Consist data input 1012 includes the number and locations of the consists within the train, the number of locomotives in the consist and the capability for distributed power control within the consist. Inputs to the train level 300 from sources other than the locomotive consist level 400 include the following: head end and end-of-train (EOT) locations, anticipate upcoming track topography and wayside equipment, movement plan, weather (wind, wet, snow), and adhesion (friction) management.

The inputs to the train level 300 from the consist level 400 is typically the aggregation of information obtained from the locomotives and potentially from the load cars. These include current operating conditions, current equipment status, equipment capability, fuel status, consumable status, consist health, optimization information for the current plan, optimization information for the plan optimization.

The current operating conditions of the consist may include the present total tractive effort (TE), dynamic braking effort, air brake effort, total power, speed, and fuel consumption rate. These may obtained by consolidating all the information from the consists at the consist level 400, which include the locomotives at the locomotive level 500 within the consist, and other equipment in the consist. The current equipment status includes the ratings of locomotives, the position of the locomotives and loads within the consist. The ratings of units may be obtained from each consist level 400 and each locomotive level 500 including derations due to adhesion/ambient conditions. This may be obtained from the consist level 400 or directly from the locomotive level 500. The position of the locomotives may be determined in part by trainline information, GPS position sensing, and air brake pressure sensing time delay. The load may be determined by the tractive effort (TE), braking effort (BE), speed and track profile.

Equipment capability may include the ratings of the locomotives in the consist including the maximum tractive effort ($TE_{max}$), maximum braking effort ($BE_{max}$), Horsepower (HP), dynamic brake HP, and adhesion capability. The fuel status, such as the current and projected amount of fuel in each locomotive, is calculated by each locomotive based on the current fuel level and projected fuel consumption for the operating plan. The consist level 400 aggregates this per-locomotive information and sends the total range and possibly fuel levels/status at known fueling points. It may also send the information where the item may become critical. For example, one locomotive within a consist may run out of fuel and yet the train may run to the next fueling station, if there is enough power available on the consist to get to that point. Similarly, the status of other consumables other than fuel like sand, friction modifiers, etc. are reported and aggregated at the consist level 400. These are also calculated based on current level and projected consumption based on weather, track conditions, the load and current plan. The train level aggregates this information and sends the total range and possibly consumable levels/status at known servicing points. It may also send the information where the item may become critical. For example, if adhesion limited operation requiring sand is not expected during the operation, it may not be critical that sanding equipment be serviced.

Figure 14:
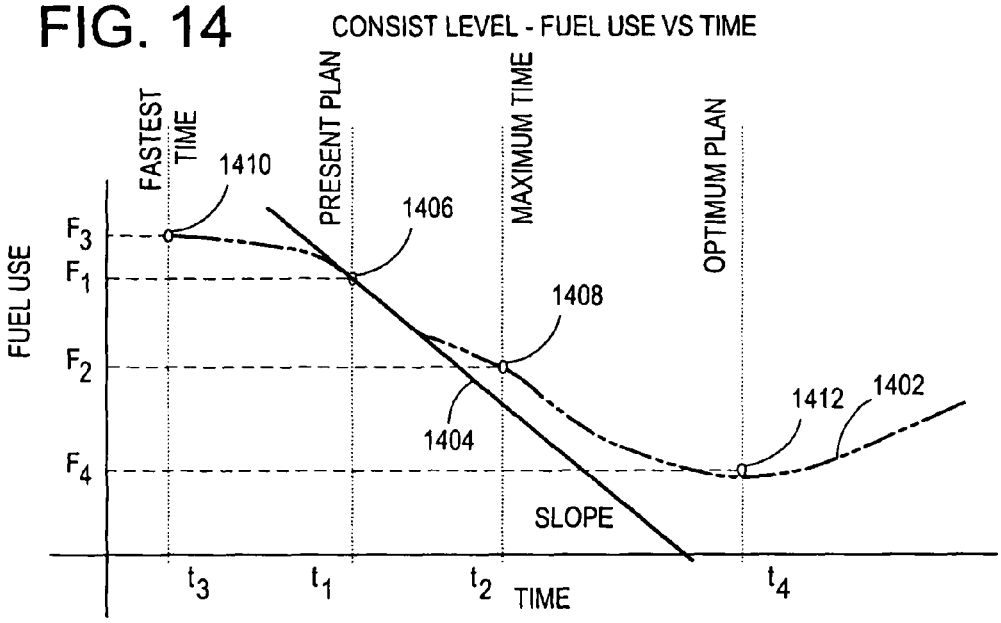
FIG. 14 is a graphic illustrating fuel usage as a function of planned time for various modes of operation at the consist level.

The health of the consist may be reported and may include failure information, degraded performance and maintenance requirements. The optimization information for the current plan may be reported. For example, this may include fuel optimization at the consist level 400 or locomotive level 500. For fuel optimization, as shown in FIG. 14, data and information for consist level fuel optimization is represented by the slope and shape of the line between operating points 1408 and 1410. Furthermore, optimization information for the plan optimization may include the data and information as depicted between operating points 1408 and 1412, as shown in FIG. 14, for the consist level 400.

Also as shown in FIG. 11, the output data 1026 sent by the train level 300 to the infrastructure level 100 includes information regarding the location, heading and speed of the train, the health of the train, operational derating of the train performance in light of the health conditions, and servicing needs, both short-term needs such as related to consumables and long-term needs such as system or equipment repair requirements. The data 1028 sent from the train level 300 to the railroad track network level 200 includes train location, heading and speed, fuel levels, range and usage and train capabilities such as power, dynamic braking, and friction management. Optimizing performance within the train level 300 includes distributing power to the consists within the train level, distributing dynamic braking loads to the consists levels within the train level and pneumatic braking to the cars within the train level, and wheel adhesion of the consists and railroad cars. The output commands to the consist level 400 includes engine speed and power generation, dynamic braking and wheel/rail adhesion for each consist. Output commands from the train level 300 to the consist level 400 include power for each consist, dynamic braking, pneumatic braking for consist overall, tractive effort (TE) overall, track adhesion management such as application of sand/lubricant, engine cooling plan, and hybrid engine plan. An example of such a hybrid engine plan is depicted in greater detail in FIG. 21.

Consist Level

Figure 12:
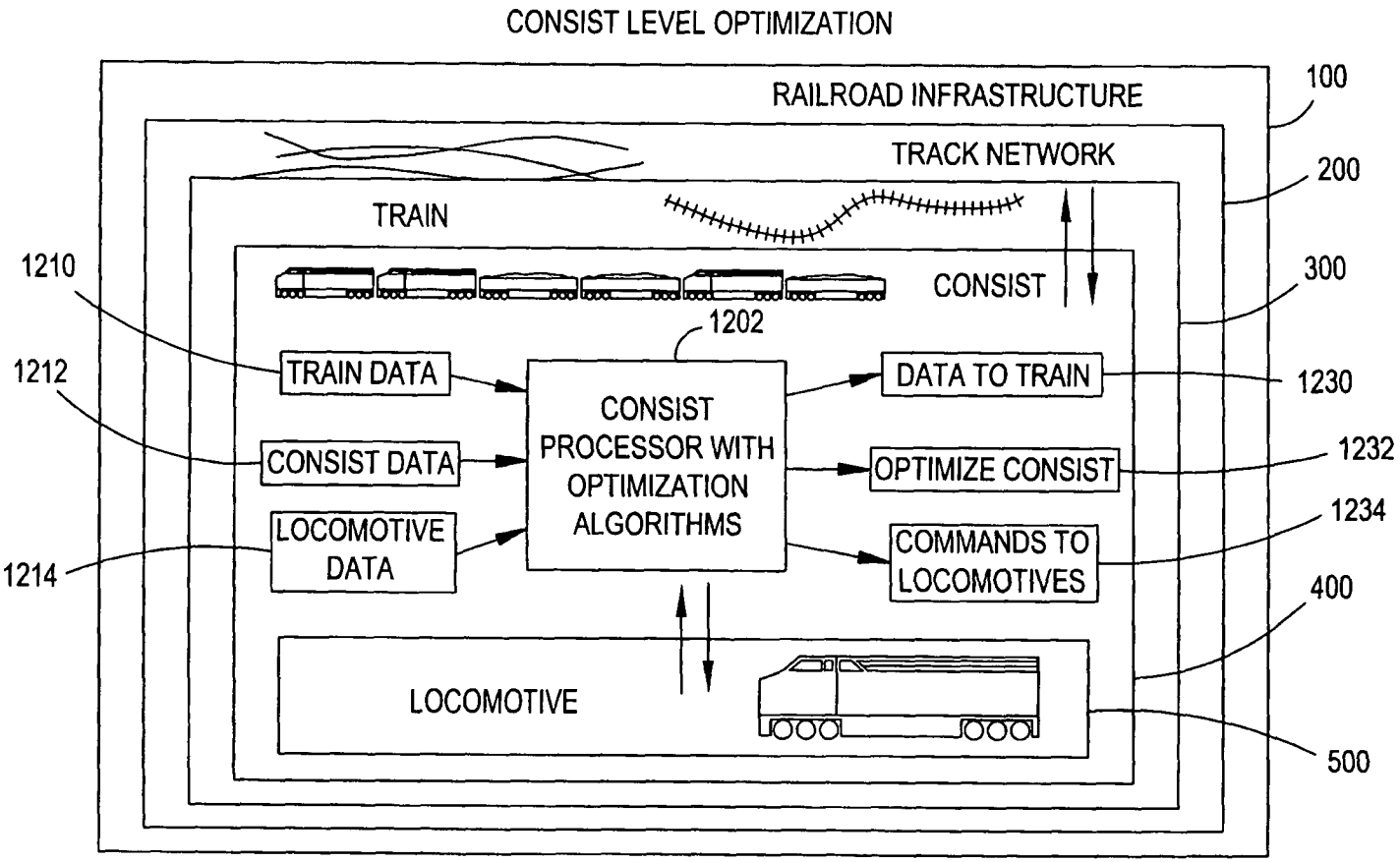
FIG. 12 is a schematic of the consist level illustrating its relationship with its related levels.
Figure 13:
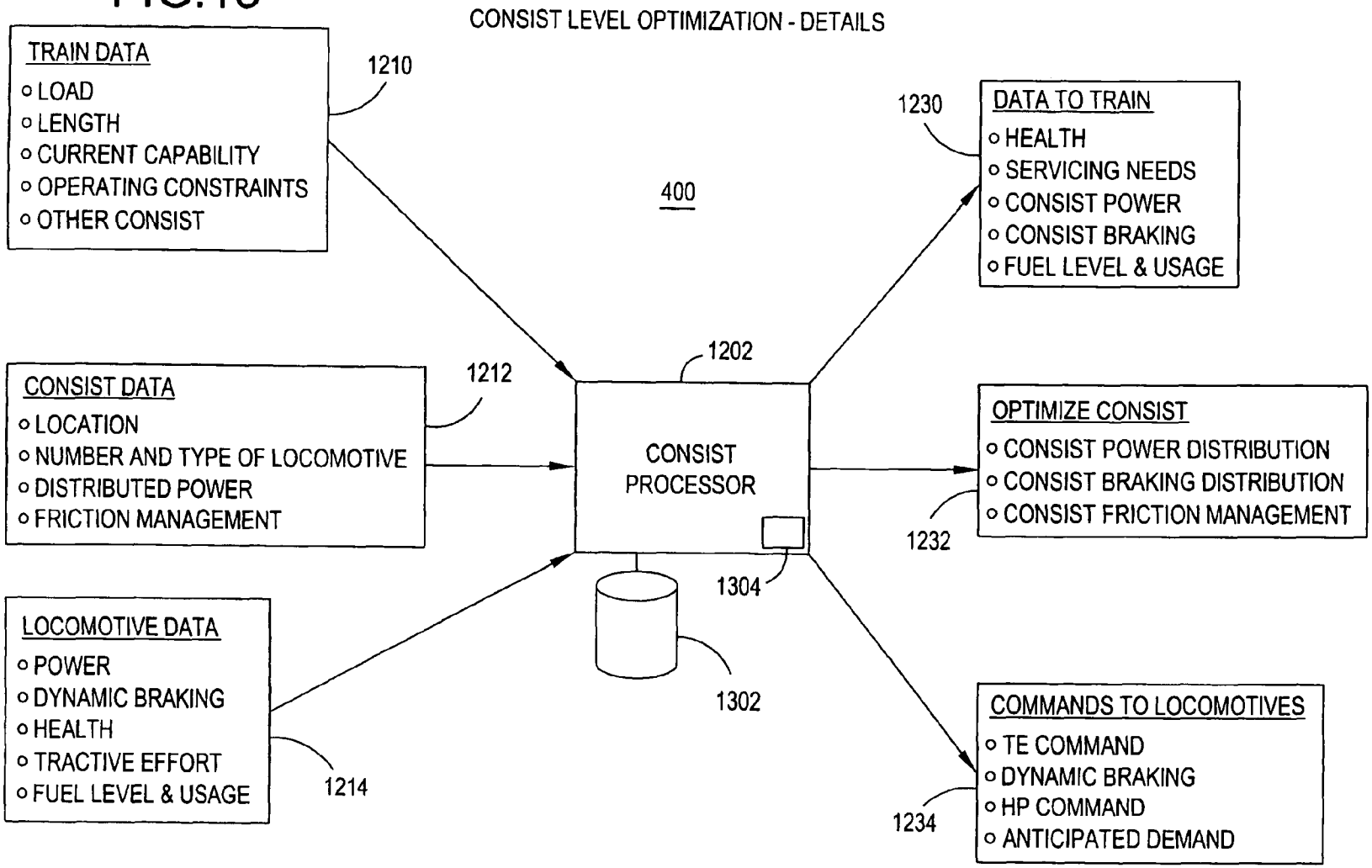
FIG. 13 is a schematic illustrating details of the inputs and outputs of the consist level processor.

FIGS. 12 and 13 illustrate the consist level relationships and exchange of data with other levels. The consist level processor 1202 includes a memory 1302 and processor instructions 1304 which includes optimization algorithms, etc. As shown in FIG. 12, the inputs to the consist level, as depicted in the consist level 400 with optimization algorithms, include data 1210 from the train level 300, data 1214 from the locomotive level 500 and data 1212 from the consist level 400. The outputs include data 1230 to the train level 300, commands 1234 to the locomotive level 500, and optimization 1232 within the consist level 400.

As an input, the train level 300 provides data 1210 associated with train load, train length, current train capability, operating constraints, and data from the one or more consists within the train level 300. Information 1210 sent from the locomotive level 500 to the consist level 400 may include current operating conditions and current equipment status. Current locomotive operating conditions includes data that is passed to the consist level to determine the overall performance of the consist. These may be used for feedback to the operator or to the railroad control system. They may also be used for consist optimization. This data may include:

1. Tractive effort (TE) (motoring and dynamic braking)—This is calculated based on current/voltage, motor characteristics, gear ratio, wheel diameter, etc. Alternatively, it may be calculated from draw bar instrumentation or train dynamics knowing the train and track information.
2. Horsepower (HP)—This is calculated based on the current/voltage alternator characteristics. It may also be calculated based on traction motor current/voltage information or from other means such as tractive effort and locomotive speed or engine speed and fuel flow rate.
3. Notch setting of throttle.
4. Air brake levels.
5. Friction modifier application, such as timing, type/amount/location of friction modifiers, e.g., sand and water.

Current locomotive equipment status may include data, in addition to one of the above items a to e, for consist optimization and for feedback to the train level and back up to the railroad track network level. This includes:

Temperature of equipment such as the engine, traction motor, inverter, dynamic braking grid, etc.

A measure of the reserve capacity of the equipment at a particular point in time and may be used determine when to transfer power from one locomotive to another.

Equipment capability such as a measure of the reserve capability. This may include engine horsepower available (considering ambient conditions, engine and cooling capability), tractive effort/braking effort available (considering track/rail conditions, equipment operating parameters, equipment capability), and friction management capability (both friction enhancers and friction reducers).

Fuel level/fuel flow rate—The amount of fuel left may be used to determine when to transfer power from one locomotive to another. The fuel tank capacity along with the amount of fuel left may be used by the train level and back up to the railroad track network level to decide the refueling strategy. This information may also be used for adhesion limited tractive effort (TE) management. For example, if there is a critical adhesion limited region of operation ahead, the filling of the fuel tank may be planned to enable filing prior to the consist entering the region. Another optimization is to keep more fuel on locomotives that can convert that weight into useful tractive effort. For example, a trailing locomotive typically has a better rail and can more effectively convert weight to tractive effort provided the axle/motor/power electronics are not limiting (from above mentioned equipment capability level). The fuel flow rate may be used for overall trip optimization. There are many types of fuel level sensors available. Fuel flow sensors are also available currently. However, it is possible to estimate the fuel flow rate from already known/sensed parameters on-board the locomotive. In one example, the fuel injected per engine stroke ($mm^3$/stroke) may be multiplied by the number of strokes/sec (function of rpm) and the number of cylinders, to determine the fuel flow rate. This may be further compensated for return fuel rate, which is a function of engine rpm, and ambient conditions. Another way of estimating the fuel flow rate is based on models using traction HP, auxiliary HP and losses/efficiency estimates. The fuel available and/or flow rate may be used for overall locomotive use balancing (with appropriate weighting if necessary). It may also be used to direct more use of the most fuel-efficient locomotive in preference to less efficient locomotives (within the constraint of fuel availability).

Fuel/Consumable range—Available fuel (or any other consumable) range is another piece of information. This is computed based on the current fuel status and the projected fuel consumption based on the plan and the fuel efficiency information available on board. Alternatively, this may be inferred from models for each of the equipment or from past performance with correction for ambient conditions or based on the combination of these two factors.

Friction modifier level—The information regarding the amount and capacity of the friction modifiers may be used for dispensing strategy optimization (transfer from one locomotive to another). This information may also be used by the railroad track network and infrastructure levels to determine the refilling strategy.

Equipment degradation/wear—The cumulative locomotive usage information may be used to make sure that one locomotive does not wear excessively. Examples of these may include the total energy produced by the engine, temperature profile of dynamic braking grids, etc. This may also allow locomotive operation resulting in more wear to some components if they are scheduled for overhaul/replacement any way.

Locomotive position—The position and/or facing direction of the locomotive may be used for power distribution consideration based on factors like adhesion, train handling, noise, and vibration.

Locomotive health—The health of the locomotive includes the present condition of the locomotive and its key subsystems. This information may be used for consist level optimization and by the track network and infrastructure levels for scheduling maintenance/servicing. The health includes component failure information for failures that do not degrade the current locomotive operation such as single axle components on an AC electromotive locomotive that does not reduce the locomotive horse power rating, subsystem degradation information, such as hot ambient condition, and engine water not fully warmed up, maintenance information such as wheel diameter mismatch information and potential rating reductions like partially clogged filters.

Figure 17:
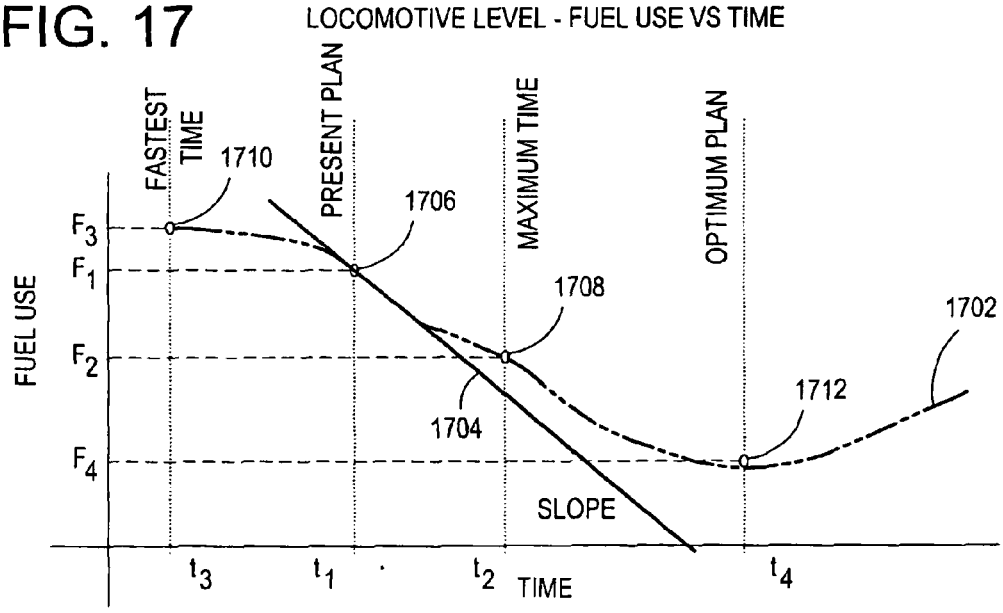
FIG. 17 is a graphic illustrating fuel usage as a function of planned time of operation for various modes of operation at the locomotive level.

Operating parameter or condition relationship information—A relation to one or more operating parameters or conditions may be defined. For example, FIG. 17 is illustrative of the type of relationship information at the locomotive level that can be developed which illustrates and/or defines the relationship between fuel use and time for a particular movement plan as shown by line 1402. This relationship information may be sent from the locomotive level 500 to the consist level 400. This may include the following:

Slope 1704 at the current operating plan time (fuel consumption reduction per unit time increase for example in gallons/sec). This parameter gives the amount of fuel reduction for every unit of travel time increase.

Fuel increase between the fastest plan 1710 and the present plan 1706. This value corresponds to the difference in fuel consumption between points $F_3$ and $F_1$, as shown on FIG. 17.

Fuel reduction between the optimum plan 1712 and the present plan 1706. This value corresponds to the difference in fuel consumption between points $F_1$ and $F_4$ of FIG. 17.

Fuel reduction between the allocated plan and current plan. This value corresponds to the difference in fuel consumption between points $F_1$ and $F_2$ of FIG. 17.

The complete fuel as a function of time profile (including range).

Any other consumable information.

For optimizations at the consist level 400, multiple closed loop estimations may be done by the consist level and each of the locomotives or the locomotive level. Among the consist level inputs from within the consist level are operator inputs, anticipated demand inputs, and locomotive optimization and feedback information.

The information flow and sources of information within the consist level include:

1. Operator inputs,
2. Movement plan inputs,
3. Track information,
4. Sensor/model inputs,
5. Inputs from the locomotives/load cars,
6. Consist optimization,
7. Commands and information to each of the locomotives in the consist,
8. Information flow for train and movement optimization, and
9. General status/health and other info about the consist and the locomotives in the consist. The consist level 400 uses the information from/about each of the locomotives in the consist to optimize the consist level operations, to provide feedback to the train level 300, and to provide instructions to the locomotive level 500. This includes the current operating conditions, potential fuel efficiency improvements possible for the current point of operation, potential operational changes based on the profile, and health status of the locomotive.

There are three categories of functions performed by the consist level 400 and the associated consist level processor 1202 to optimize consist performance. Internal consist optimization, consist movement optimization, and consist monitoring and control.

Internal optimization functions/algorithms optimize the consist fuel consumption by controlling operations of various equipments internal to the consist like locomotive throttle commands, brake commands, friction modifier commands, anticipatory commands. This may be done based on current demand and by taking into account future demand. The optimization of the performance of the consist level include power and dynamic braking distribution among the locomotives within the consist, as well as the application of friction enhancement and reducers at points along the consist for friction management. Consist movement optimization functions and algorithms help in optimizing the operation of the train and/or the operation of the movement plan. Consist control/monitoring functions help the railroad controllers with data regarding the current operation and status of the consist and the locomotives/loads in the consist, the status of the consumables, and other information to help the railroad with consist/locomotive/track maintenance.

Figure 18:
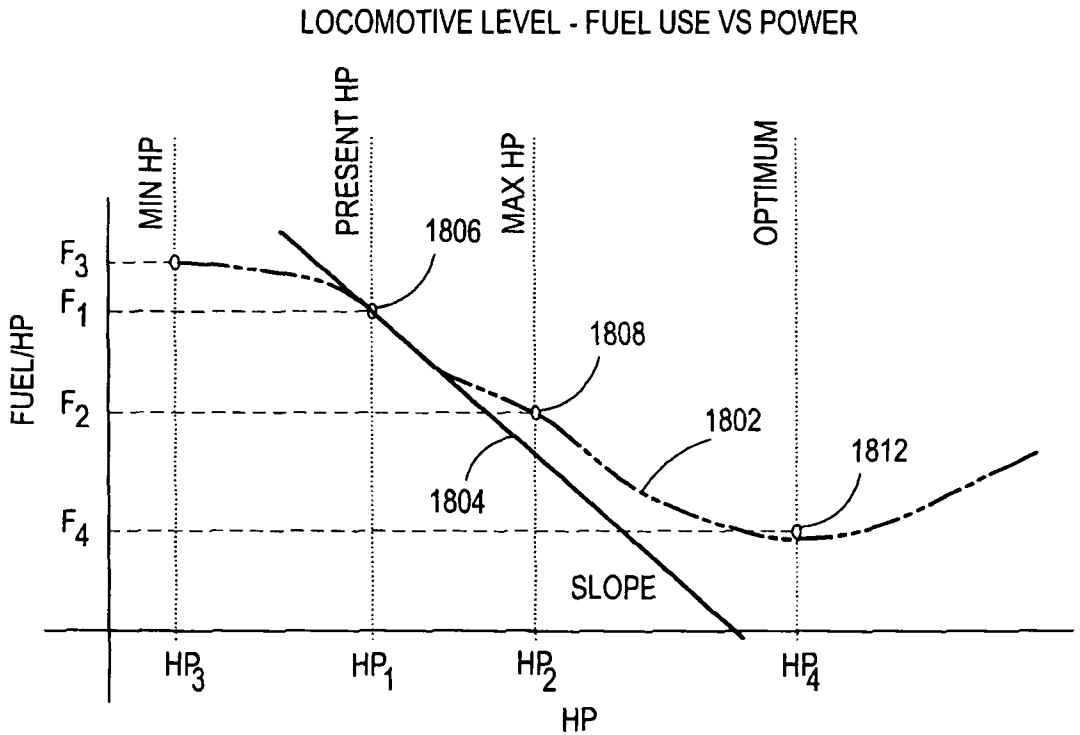
FIG. 18 is a graphic illustrating locomotive level fuel efficiency as measured in fuel usage per unit of power as a function the amount of power generated at the locomotive level for various modes of operation.

The consist level 400 optimization provides for optimization of current consist operations. For consist optimization, in addition to the above listed information other information can also be sent from the locomotive. For example, to optimize fuel, the relationship between fuel/HP (measure of fuel efficiency) and horsepower (HP) as shown in FIG. 18 by line 1802 may be passed from each locomotive to the consist level controller 1202. One example of this relationship is shown in FIG. 18. Referring to FIG. 18, the data may also include one or more of the following items:

Slope 1804 of Fuel/HP as a function of HP at the present operating horsepower. This parameter provides a measure of fuel rate increase per horsepower increase.

Maximum horsepower 1808 and the fuel rate increase corresponding to this horsepower.

Most efficient operating point 1812 information. This includes the horsepower and the fuel rate change to operate at this point.

Complete fuel flow rate as a function of horsepower.

The update time and the amount of information may be determined based on the type and complexity of the optimization. For example, the update may be done based on significant changes. These include notch change, large speed change or equipment status changes including failures or operating mode changes or significant fuel/HP changes, for example, a variation of 5 percent. The ways of optimizing include sending only the slope (item a above) at the current operating point and may be done at a slow data rate, for example, at once per second. Another way is to send items a, b and c once and then to send the updates only when there is a change. Another option is to send only item d once and only update points that change periodically such as once per second.

Optimization within the consist considers factors such as fuel efficiency, consumable availability and equipment/subsystem status. For example, if the current demand is for 50% horsepower for the whole consist (prior art consists have all of the locomotives at the same power, here at 50% horsepower for each), it may be more efficient to operate some locomotives at less than a 50% horsepower rating and other locomotives at more than a 50% horsepower rating so that the total power generated by the consist equals the operator demand. In this case, higher efficiency locomotives will be operating at a higher horsepower than the lower efficiency locomotives. This horsepower distribution may be obtained by various optimizing techniques based on the horsepower as a function of fuel rate information obtained from each locomotive. For example, for small horsepower distribution changes, the slope of the function of the horsepower as a function of the fuel rate may be used. This horsepower distribution may be modified for achieving other objective functions or to consider other constraints, such as train handling/drawbar forces based on other feedback from the locomotives. For example, if one of the locomotives is low on fuel, it may be necessary to reduce its load so as to conserve fuel if this locomotive is required to produce a large amount of energy (horsepower/hour) before refueling, even if this locomotive is the most efficient one.

Other input information from each locomotive at the locomotive level 500 may be provided to the consist level 400. This other information from the locomotive level includes:

Maintenance cost. This includes the routine/scheduled maintenance cost due to wear and tear that depends on horsepower (ex. $/kwhr) or tractive effort increase.

Transient capability. This may be expressed in terms of the continuous operating capability of the locomotive, maximum capability of the locomotive and the transient time constant and gain.

Fuel efficiency at each point of operation.

Slope at every point of operation. This parameter gives the amount of fuel rate increase per horsepower increase.

Maximum horsepower at every point of operation and the fuel rate increase corresponding to this horsepower.

Most efficient operating point information at every point of operation. This includes the horsepower and the fuel rate change to operate at this point.

Complete fuel flow rate vs. horsepower curve at every point of operation.

Fuel (and other consumable) range, based on current fuel level and the plan and the projected fuel consumption rate.

If the complete profile information is known, the overall consist optimization considers the total fuel and consumables spent. Other weighting factors that may be considered include cost of locomotive maintenance, transient capability and issues like train handling, and adhesion limited operation. Additionally, if the shape of the consist level fuel use as a function of time as depicted by FIG. 14 changes significantly due to its transient nature (for example, the temperature of the electrical equipments such as traction motors, alternators or storage elements), then this curve needs to be regenerated for various potential power distributions for the current plan. Similar to the previous section, the data may be sent periodically or once at the beginning and updates sent only when there is a significant change.

As input to the movement plans, optimization information may be developed at the consist level 400. Information may be sent from the locomotive level 500 to be combined by the consist level with other information or aggregated with other locomotive level data for use by the railroad network level 200. For example, to optimize fuel, fuel consumption information as a function of plan time, e.g., the time to reach the destination or an intermediate point like meet or pass, may be passed from each locomotive to the consist controller 1202.

To illustrate one embodiment of the operation of optimization at the consist level 400, FIG. 14 illustrates the consist level as a function of fuel use versus time. A line denoted as 1402 represents fuel use vs. time at the consist level for a consist scheduled to go from point A to point B (not illustrated). FIG. 14 shows the fuel consumption as a function of time as derived by the train. The slope of line 1404 is the fuel consumption vs. time at the present plan. Point 1406 corresponds to the current operation, 1408 to the maximum time allocated, 1410 corresponds to the best time it may make and 1412 corresponds to the most fuel efficient operation. Under the current plan, it will consume a certain amount of fuel and will get there after a certain elapsed time $t_1$. It is also assumed that between points A and B, the train at the consist level assumes to operate without regard to other trains on the system as long as it can reach its destination within the time currently allocated to it, e.g., $t_2$. Optimization is run autonomously on the train to reach point B.

As noted above, the outputs of the consist level 400 include data to the train level 300, commands and controls to the locomotive level 500 as well as the internal consist level 400 optimization. The consist level output 1230 to the train level includes data associated with the health of the consist, service requirements of the consist, the power of the consist, the consist braking effort, the fuel level, and fuel usage of the consist. In one embodiment, the consist level sends the following types of additional information for use in the train level 300 for train level optimization. To optimize on fuel only, fuel consumption information as a function of plan time (time to reach the destination or an intermediate point like meet or pass) can be passed from each of the consists to the train/railroad controller. FIG. 14 discloses one embodiment of the invention for fuel optimization and identifies the type of information and relationship between the fuel use and the time that can be sent by the consist level to the train level. Referring to FIG. 14, this includes one or more of the items listed below.

Slope 1404 at the current operating plan time (fuel consumption reduction per unit time increase: gallons/sec). This parameter gives the amount of fuel reduction for every unit of time increase.

Fuel increase between the fastest plan and the current plan. This value corresponds to the difference in fuel consumption between points 1410 and 1406.

Fuel reduction between the best and current plan. This value corresponds to the difference in fuel consumption between points 1406 and 1412, of FIG. 14.

Fuel reduction between the allocated plan and current plan. This value corresponds to the difference in fuel consumption between points 1406 and 1408 of FIG. 14.

The complete fuel as a function of time profile as depicted in FIG. 14 by the line 1402.

As noted in FIG. 13, the consist level 400 provides output commands to the locomotive level 500 about current engine speed and power generation and anticipated demands. Dynamic braking and horsepower requirements are also provided to the locomotive level. The signals/commands from the consist level to the locomotive level or the locomotive within the consist level include operating commands, adhesion modification commands, and anticipatory controls.

Figure 21:
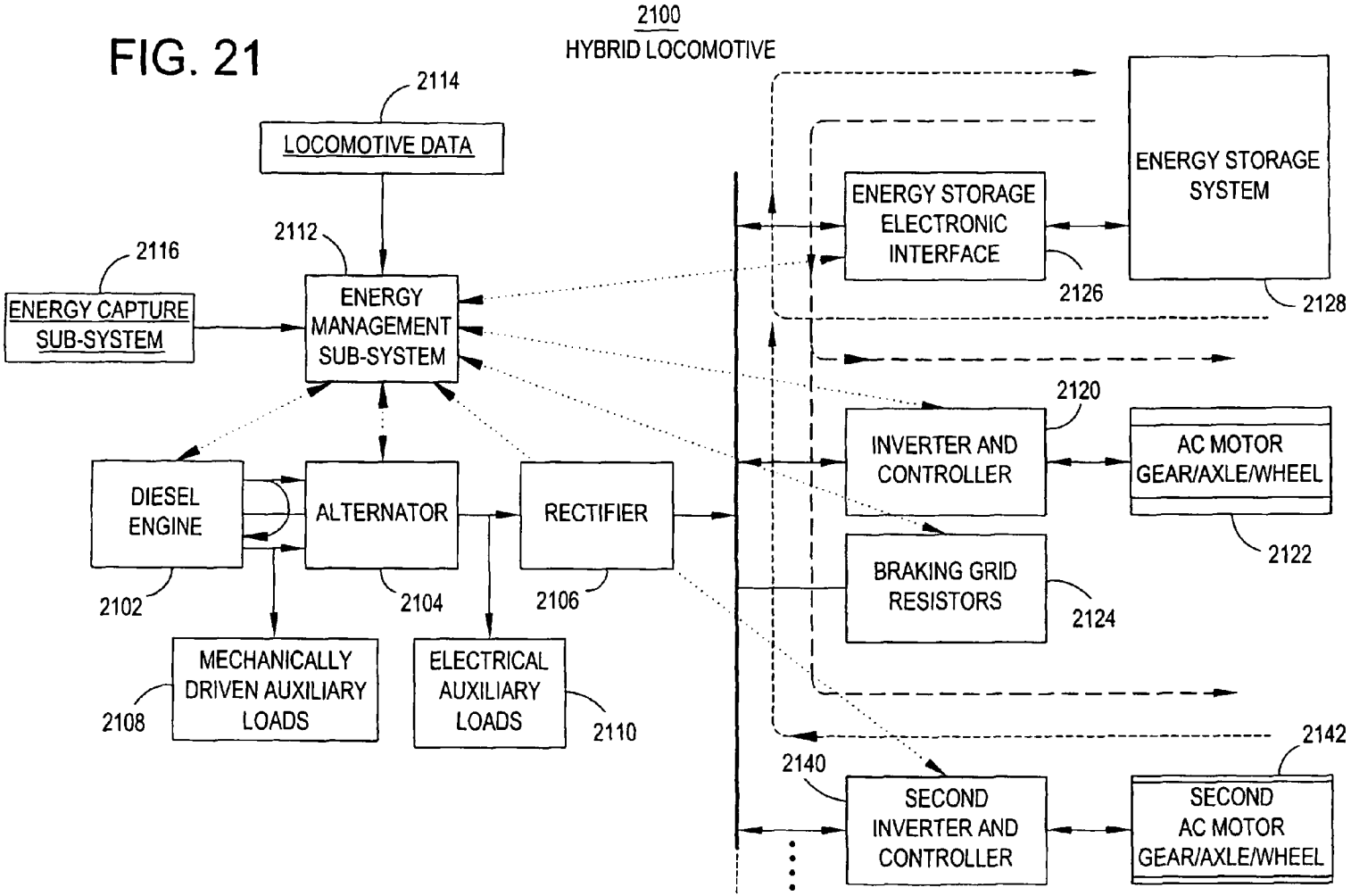
FIG. 21 is a schematic of an energy management subsystem of a hybrid energy locomotive having an on-board energy regeneration and storage capability as configured and operated for fuel optimization.

Operating commands may include notch settings for each of the locomotives, tractive effort/dynamic braking effort to be generated for each of the locomotives, train air brake levels (which may be expanded to individual car air brake in the event electronic air brakes are used and when individual cars/group of cars are selected), and independent air brake levels on each of the locomotives. Adhesion modification commands are sent to the locomotive level or cars (for example, at the rear of the locomotive) to dispense friction-enhancing material (sand, water, or snow blaster) to improve adhesion of that locomotive or the trailing locomotives or for use by another consist using the same track. Similarly, friction lowering material dispensing commands are also sent. The commands include, the type and amount of material to be dispensed along with the location and duration of material dispensing. Anticipatory controls include actions to be taken by the individual locomotives within the locomotive level to optimize the overall trip. This includes pre-cooling of the engine and/or electrical equipment to get better short-term rating or get through high ambient conditions ahead. Even pre-heating may be performed (for example, water/oil may need to be at a certain temperature to fully load the engine). Similar commands may be sent to the locomotive level and/or storage tenders of a hybrid locomotive, as is depicted in FIG. 21, to adjust the amount of energy storage in anticipation of a demand cycle ahead.

The timing of updates sent to and from the consist level and the amount of information can be determined based on the type and complexity of the optimization. For example, the update may occur at a predetermined point in time, at regularly scheduled times or when significant changes occur. These later ones may include: significant equipment status changes (for example the failure of a locomotive) or operating mode changes such as the degraded operation due to adhesion limits, or significant fuel, horsepower, or schedule changes such as a change in the horsepower by 5 percent. There are many ways of optimizing based on these parameters and functions. For example, only the slope (item a above) of the fuel use as a function of the time at the current operating point may be sent and this may be done at a slow rate, such as once every 5 minutes. Another way is to send items a, b and c once and only send updates when there is a change. Yet another option is to send only item d once and only update points that change periodically, such as once every 5 minutes.

As indicated in the earlier discussion, with simplified versions of train configurations, such as single locomotive consists and/or single locomotive trains, the relationship and extent of communication between the train level 300, consist level 400 and locomotive level 500 becomes less complex, and in some embodiments, collapses into a less than three separately functioning levels or processors, with possibly all three levels operating within a single functioning level or processor.

Locomotive Level

Figure 15:
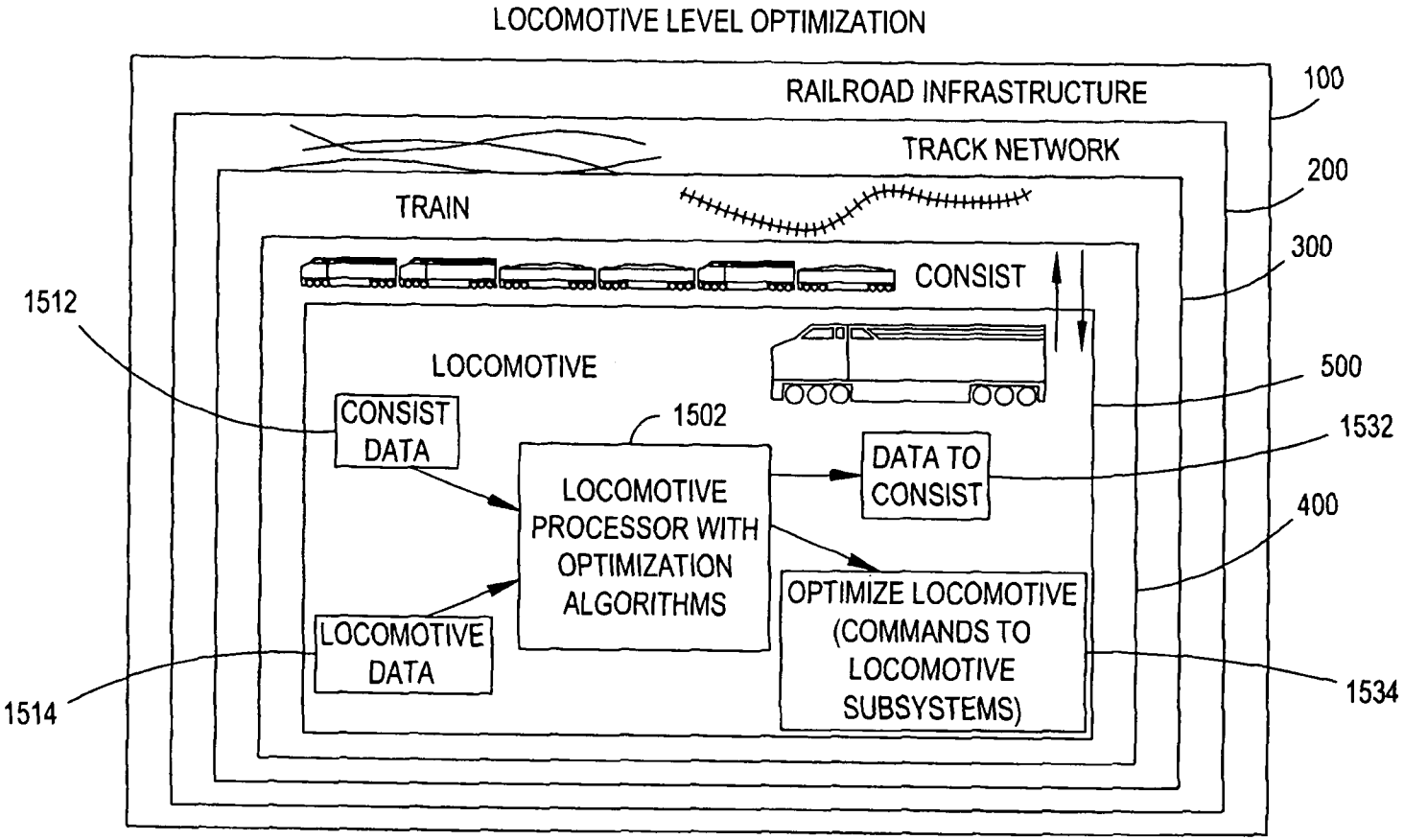
FIG. 15 is a schematic of the locomotive level illustrating its relationships with the consist level.
Figure 16:
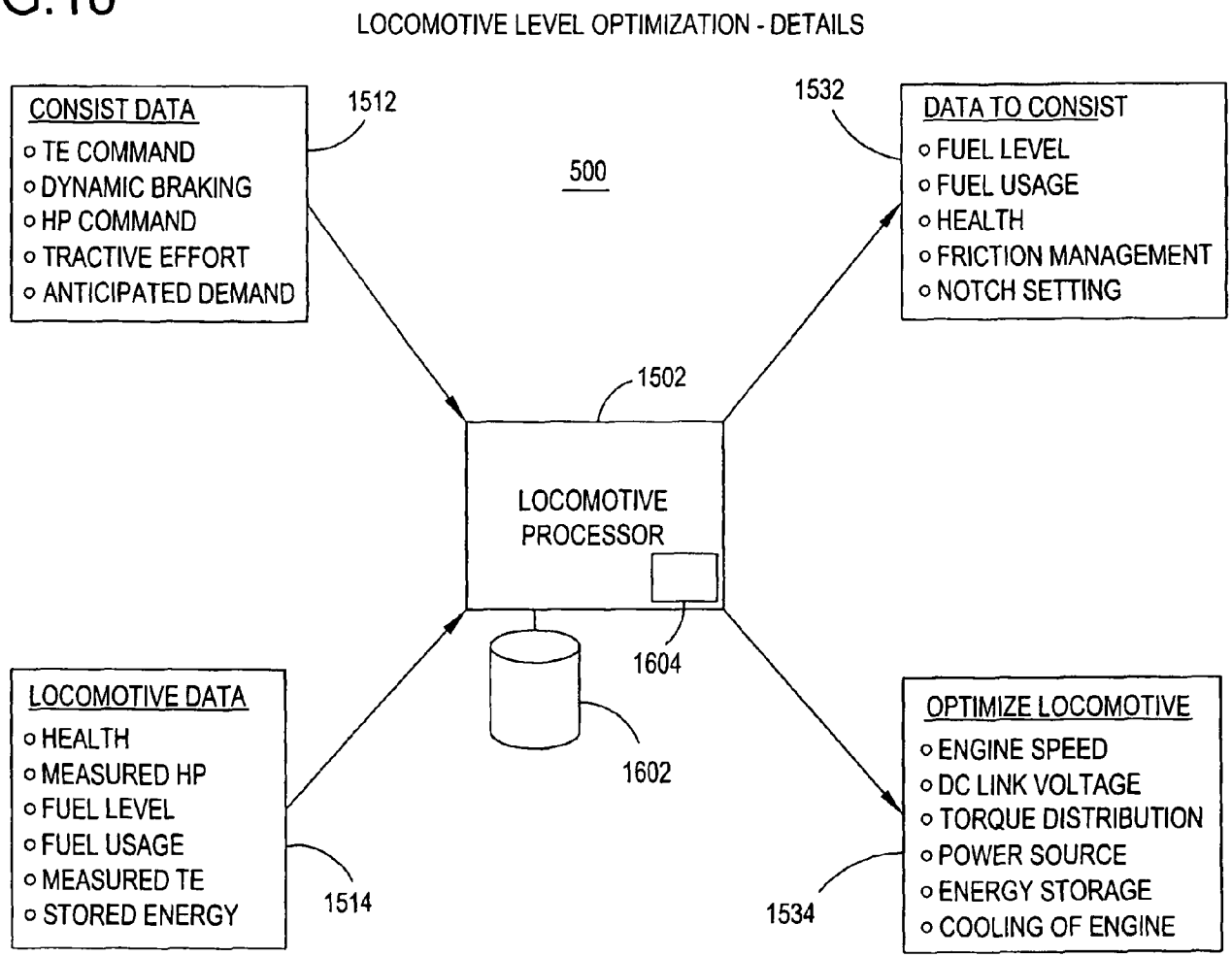
FIG. 16 is a schematic illustrating details of the inputs and outputs of the locomotive level processor.

FIGS. 15 and 16 illustrate the locomotive level 500 relationship with the consist level 400 and optimization of the locomotive internal operation via commands to the various locomotive subsystems. The locomotive level includes a processor 1502 with optimization algorithms, which may be in the form of a memory 1602 and processing instructions 1604, etc. The input data to the locomotive level includes consist level data 1512 and data 1514 from the locomotive level (including locomotive feedback). The output from the locomotive level includes data 1532 to the consist level and optimization of performance data 1534 at the locomotive level. As shown in FIG. 16, the input data 1512 from the consist level includes tractive effort command, locomotive engine speed and horsepower generation, dynamic braking, friction management parameters, and anticipated demands on the engine and propulsion system. The input data 1514 from the locomotive level include locomotive health, measured horsepower, fuel level, fuel usage, measured tractive effort and stored electric energy. The later is applicable to embodiments utilizing hybrid vehicle technology as shown and described hereinafter in connection with the hybrid vehicle of FIG. 21. The data output 1532 to the consist level include locomotive health, friction management, notch setting, and fuel usage, level and range. The locomotive optimization commands 1534 to the locomotive subsystems include engine speed to the engine, engine cooling for the cooling system for the engine, DC link voltage to the inverters, torque commands to the traction motors, and electric power charging and usage from the electric power storage system of hybrid locomotives. Two other types of inputs include operator inputs and anticipated demand inputs.

The information flow and sources of information at the locomotive level 500 include:

a. Operator inputs,
b. Movement plan inputs,
c. Track information,
d. Sensor/model inputs,
e. Onboard optimization,
f. Information flow for consist and movement optimization, and
g. General status/health and other information for consist consolidation and for railroad optimization/scheduling.

Three categories of functions performed by the locomotive level include internal optimization functions/algorithms, locomotive movement optimization functions/algorithms, and locomotive control/monitoring. Internal optimization functions/algorithms optimize the locomotive fuel consumption by controlling operations of various equipments internal to the locomotive, e.g., engine, alternator, and traction motor. This may be done based on current demand and by taking into account future demand. Locomotive movement optimization functions and/or/algorithms help in optimizing the operation of the consist and/or the operation of the movement plan. Locomotive control/monitoring functions help the consist and railroad controllers with data regarding the current operation and status of the locomotive, the status of the consumables and other information to help the railroad with locomotive and track maintenance.

Based on the constraints imposed at the locomotive level, operation parameters that may be optimized include engine speed, DC link voltage, torque distribution and source of power.

For a given horsepower command, there is a specific engine speed which produces the optimum fuel efficiency. There is a minimum speed below which the diesel engine cannot support the power demand. At this engine speed the fuel combustion does not happen in the most efficient manner. As the engine speed increases the fuel efficiency improves. However, losses like friction and windage increase and therefore an optimum speed can be obtained where the total engine losses are the minimum. This fuel consumption vs. engine speed is illustrated in FIG. 20 where the curve 2002 is the total performance range of the locomotive and point 2004 is the optimum performance for fuel usage vs. speed.

Figure 19:
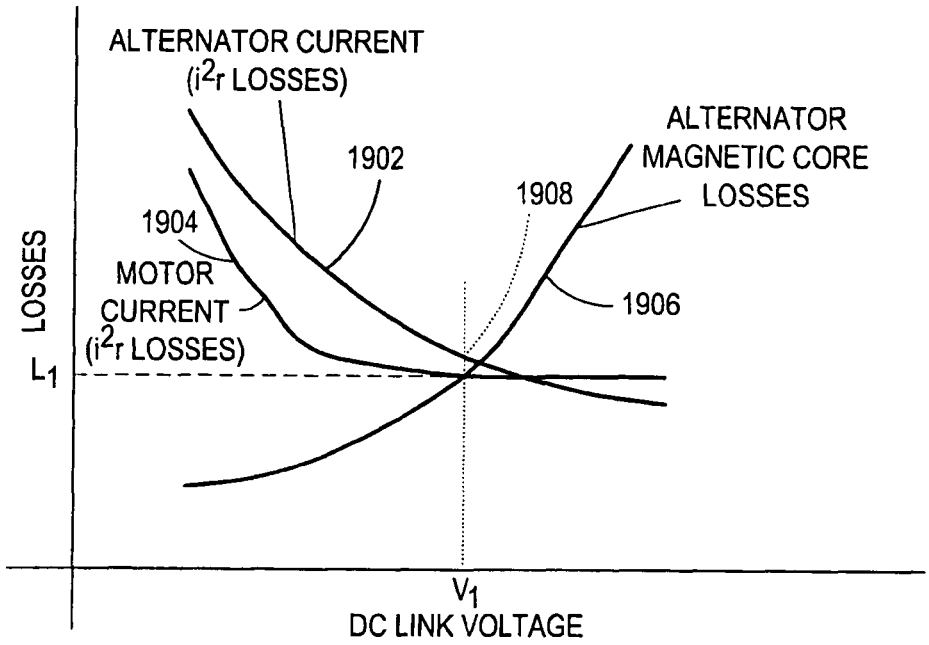
FIG. 19 is a graphic illustrating various electrical system losses as a function of DC link voltage at the locomotive level.

The DC link voltage on an AC locomotive determines the DC link current for a given power level. The voltage typically determines the magnetic losses in the alternator and the traction motors. Some of these losses are illustrated in FIG. 19. The voltage also determines the switching losses in the power electronics devices and snubbers. It also determines the losses in the devices used to produce the alternator field excitation. On the other hand, current determines the $i^2r$ losses in the alternator, traction motors and the power cables. Current also determines the conduction losses in the power semiconductor devices. The DC link voltage can be varied such that the sum of all the losses is a minimum. As shown in FIG. 19, for example, the alternator current losses vs. DC link voltage are plotted as line 1902 the alternator magnetic core losses vs. DC link voltage are plotted as line 1906 and the motor current losses vs. DC link voltage are plotted as line 1904 which are substantially optimized at line 1908 at DC link voltage $V_1$.

For a specific horsepower demand, the distribution of power (torque distribution) to the six traction axles of one embodiment of a locomotive may be optimized for fuel efficiency. The losses in each traction motor, even if it is producing the same torque or same horsepower, can be different due to wheel slip, wheel diameter differences, the operating temperature differences and the motor characteristics differences. Therefore, the distribution of the power between each axles can be used to minimize the losses. Some of the axles may even be turned off to eliminate the electrical losses in those traction motors and the associated power electronic devices.

In locomotives with additional power sources, for example, hybrid locomotives such as shown in FIG. 21, the optimum power source selection and the appropriate amount of energy drawn from each of the sources (so that the sum of the power delivered is what the operator is demanding), determines the fuel efficiency. Hence locomotive operation may be controlled to obtain the best fuel-efficient point of operation at any time.

For consists or locomotives equipped with friction management systems, the amount of friction seen by the load cars (especially at higher speeds) may be reduced by applying friction reducing material on to the rail behind the locomotive. This reduces the fuel consumption since the tractive effort required to pull the load has been reduced. This amount and timing of dispensing may be further optimized based on the knowledge of the rail and load characteristics.

A combination of two or more of the above variables (engine speed, DC link voltage and torque distribution) along with auxiliaries like engine and equipment cooling may be optimized. For example, the maximum DC link voltage available is determined by the engine speed and hence it is possible to increase the engine speed beyond the optimum (based on engine only consideration) to obtain a higher voltage resulting in an optimum operating point.

There are other considerations for optimization once the overall operating profile is known. For example, parameters and operations such as locomotive cooling, energy storage for hybrid vehicles, and friction management materials may be utilized. The amount of cooling required can be adjusted based on anticipated demand. For example, if there is big demand for tractive effort ahead due to high grade, the traction motors may be cooled ahead of time to increase its short term (thermal) rating which will be required to produce high tractive effort. Similarly if there is a tunnel ahead if the engine and other components may be pre-cooled to enable operation through the tunnel to be improved. Conversely, if there is a low demand ahead, then the cooling may be shut down (or reduced) to take advantage of the thermal mass present in the engine cooling and in the electric equipment such as alternators, traction motors, power electronic components.

In a hybrid vehicle, the amount of power in a Hybrid Vehicle that should be transferred in and out of the energy storage system may be optimized based on the demand that will be required in the future. For example, if there is a large period of dynamic brake region ahead, then all the energy in the storage system can be consumed now (instead of from the engine) so as to have no stored energy at the beginning of dynamic brake region (so that the maximum energy may be recaptured during the dynamic brake region of operation). Similarly if there is a heavy power demand expected in the future, the stored energy may be increased for use ahead.

The amount and duration of dispensing of friction increasing material (like sand) can be reduced if the equipment rating is not needed ahead. The trailing axle power/tractive effort rating may be increased to get the maximum available adhesion without expending these friction-enhancing resources.

There are other considerations for optimization other than fuel. For example, emissions may be another consideration especially in cities or highly regulated regions. In those regions it is possible to reduce emissions (smoke, Nitrogen Oxide, etc.) and trade off other parameters like fuel efficiency. Audible noise may be another consideration. Consumable conservation under certain constraints is another consideration. For example, dispensing of sand or other friction modifiers in certain locations may be discouraged. These location specific optimization considerations may be based on the current location information (obtained from operator inputs, track inputs, GPS/track information along with geofence information). All these factors are considered for both the current demand and for optimizations for the overall operating plan.

Hybrid Locomotive

Referring to FIG. 21, a hybrid locomotive level 2100 is shown having an energy storage subsystem 2116. The energy management subsystem 2112 controls the energy storage subsystem 2116 and the various locomotive components, such as diesel engine 2102, alternator 2104, rectifier 2106, mechanically driven auxiliary loads 2108, and electrical auxiliary loads 2110 that generate and/or use electrical power. This management subsystem 2112 operates to direct available electric power such as that generated by the traction motors during dynamic braking or excess power from the engine and alternator, to the energy storage subsystem 2116, and to release this stored electrical power within the consist to aid in the propulsion of the locomotive during monitoring operations.

To do so, the energy management subsystem 2112 communicates with the diesel engine 2102, alternator 2104, inverters and controllers 2120 and 2140 for the traction motors 2122 and 2142 and the energy storage subsystem interface 2126.

As described above, a hybrid locomotive provides additional capabilities for optimizing locomotive level 500 (and thus consist and train level) performance. In some respects, it allows current engine performance to be decoupled from the current locomotive power demands for motoring, so as to allow the operation of the engine to be optimized not only for the present operating conditions, but also in anticipation of the upcoming topography and operational requirements. As shown in FIG. 21, locomotive data 2114, such as anticipated demand, anticipated energy storage opportunities, speed and location, are input into the energy management sub-system 2112 of the locomotive layer. The energy management subsystem 2112 receives data from and provides instructions to the diesel engine controls and system 2102, and the alternator and rectifier control and systems 2104 and 2106, respectively. The energy management sub-system 2112 provides control to the energy storage system 2128, the inverters and controllers of the traction motors 2120 and 2140, and the braking grid resistors 2124.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

Those skilled in the art will note that the order of execution or performance of the methods illustrated and described herein is not essential, unless otherwise specified. That is, it is contemplated that aspects or steps of the methods may be performed in any order, unless otherwise specified, and that the methods may include more or less aspects or steps than those disclosed herein.

While various embodiments of the present invention have been illustrated and described, it will be appreciated to those skilled in the art that many changes and modifications may be made thereunto without departing from the spirit and scope of the invention. As various changes could be made in the above constructions without departing from the scope of the invention, it is intended that all matter contained in the above description or shown in the accompanying drawings shall be interpreted as illustrative and not in a limiting sense

What is claimed is:

1. A multi-level system for management of a railway system and its operational components, the system comprising:

a first level being a railroad infrastructure level, configured to control an operation within the first level, said first level including first level operational parameters defining changes in operational characteristics of service facilities of a railroad infrastructure and data of the first level, said controlling a servicing operation comprising issuing a work order to a service facility for implementing the servicing operation, said work order comprising at least one of the following: refueling instructions, scheduling a work bay, scheduling a work crew, scheduling a tool, or ordering a part, said first level configured to optimize an operation within the first level;

a second level being a track network level, configured to control an operation within the second level, said second level including second level operational parameters defining changes in the operational characteristic and data of the second level, wherein the second level is a sub-level of said first level;

said second level including a movement planner for analyzing the second level operational parameters for movement of a plurality of trains over a track layout, the second level configured to optimize an operation within the second level including optimizing fuel usage within the track network based on a business objective function of each of the trains, an engine performance of the trains, congestion data, and fuel weighting factors;

said first level providing the second level with the first level operational parameters at regularly scheduled intervals, and the second level providing the first level with the second level operational parameters at periodic intervals;

said controlling the operation within the first level and said controlling the operation within the second level each being a function of both the first and second level operational parameters; and wherein the system is configured to optimize a system operation across a combination of the first level and the second level based on a system optimization parameter, to optimize an operation within the first level based on a first level optimization parameter and the system optimization parameter, and to optimize an operation within the second level based on a second level optimization parameter and the system optimization parameter.

2. The system of claim 1 wherein at least one of the first level operational parameters and second level operational parameters are indicative of an economic valuation of the time of delivery of cargo carried in the railway system.

3. The system of claim 1 wherein the operational parameters are indicative of predetermined changes in conditions over a period of time.

4. The system of claim 3 wherein the operational parameters are indicative of a rate of change in the conditions.

5. The system of claim 4 wherein the rate of change is with respect to time.

6. The system of claim 4 wherein the rate of change is the change in one condition with respect to another.

7. The system of claim 1 wherein an operational parameter of the second level relevant to the system optimization parameter is communicated periodically from the second level to the first level for adjusting the first and second level operational parameters based thereon.

8. The system of claim 7 wherein controlling the operation within the first level and controlling the operation within the second level includes identifying operating constraints and data at one of the first and second level and communicating these operating constraints and data to another of the first and second level to improve performance of the operation at the another level.

* * * * *